US012465082B2

(12) United States Patent
Lee et al.

(10) Patent No.: US 12,465,082 B2
(45) Date of Patent: Nov. 11, 2025

(54) AEROSOL-GENERATING DEVICE

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 394 days.

(21) Appl. No.: 18/013,204

(22) PCT Filed: Jan. 10, 2022

(86) PCT No.: PCT/KR2022/000368
§ 371 (c)(1),
(2) Date: Dec. 27, 2022

(87) PCT Pub. No.: WO2022/158772
PCT Pub. Date: Jul. 28, 2022

(65) Prior Publication Data

US 2023/0276846 A1 Sep. 7, 2023

(30) Foreign Application Priority Data

Jan. 22, 2021 (KR) ..... 10-2021-0009173

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/44* (2020.01); *A24F 40/485* (2020.01); *A24F 40/51* (2020.01); *A24F 40/53* (2020.01)

(58) Field of Classification Search
None
See application file for complete search history.

(56) References Cited

U.S. PATENT DOCUMENTS 5,967,148 A 10/1999 Harris et al.
9,888,714 B2 2/2018 Cameron et al.
(Continued)

FOREIGN PATENT DOCUMENTS

CN 111757560 10/2020
EP 3750418 12/2020
(Continued)

OTHER PUBLICATIONS

European Patent Office Application Serial No. 22742748.1, Search Report dated Nov. 18, 2024, 12 pages.
(Continued)

*Primary Examiner* — Cynthia Szewczyk
(74) *Attorney, Agent, or Firm* — LEE, HONG, DEGERMAN, KANG & WAIMEY

(57) ABSTRACT

An aerosol-generating device is disclosed. The aerosol-generating device includes comprising an inner wall and an outer wall, wherein the inner wall defines an insert space configured to accommodate insertion of an aerosol-generating member, and wherein a chamber configured to store liquid is defined between the inner wall and the outer wall; a wick disposed at an end of the insert space; a heater configured to heat the wick; a passage formed between the insert space and the wick; and an infrared sensor disposed adjacent to the insert space.

12 Claims, 22 Drawing Sheets

(51) Int. Cl.

| | |
|---|---|
| ***A24F 40/44*** | (2020.01) |
| ***A24F 40/485*** | (2020.01) |
| ***A24F 40/51*** | (2020.01) |
| ***A24F 40/53*** | (2020.01) |

(56) References Cited

U.S. PATENT DOCUMENTS

| | | | | |
|---|---|---|---|---|
| 2019/0191783 | A1 | 6/2019 | Courbat et al. | |
| 2020/0093185 | A1* | 3/2020 | Lim | A24F 40/53 |
| 2020/0146347 | A1 | 5/2020 | Sears et al. | |
| 2020/0288778 | A1 | 9/2020 | Kim et al. | |
| 2020/0323268 | A1 | 10/2020 | Thorens et al. | |
| 2020/0383379 | A1 | 12/2020 | Yilmaz | |

FOREIGN PATENT DOCUMENTS

| | | | | |
|---|---|---|---|---|
| JP | 2019-528751 | | 10/2019 | |
| JP | 2020-521438 | | 7/2020 | |
| KR | 10-2018-0108613 | | 10/2018 | |
| KR | 10-2019-0097277 | | 8/2019 | |
| KR | 10-2021-0000980 | | 1/2021 | |
| RU | 2018107284 | | 8/2019 | |
| RU | 2700021 | | 9/2019 | |
| RU | 2709926 | | 12/2019 | |
| RU | 2738546 | | 12/2020 | |
| RU | 2738549 | | 12/2020 | |
| WO | 2018127417 | | 7/2018 | |
| WO | 2020161489 | | 8/2020 | |
| WO | 2020194112 | | 10/2020 | |
| WO | 2020227284 | | 11/2020 | |
| WO | 2021071203 | | 4/2021 | |
| WO | WO-2021122475 | A1 * | 6/2021 | A24D 1/02 |
| WO | 2022197007 | | 9/2022 | |

OTHER PUBLICATIONS

Russian Federation Federal Service for Intellectual Property, Patents and Trademarks Application Serial No. 2023100749/03, Office Action dated Jun. 2, 2023, 7 pages.

Korean Intellectual Property Office Application No. 10-2021-0009173, Notice of Allowance dated Jul. 6, 2023, 2 pages.

Japan Patent Office Application No. 2023-516271, Office Action dated Apr. 2, 2024, 4 pages.

Korean Intellectual Property Office Application No. 10-2021-0009173, Office Action dated Jan. 25, 2023, 2 pages.

PCT International Application No. PCT/KR2022/000368, International Search Report dated May 2, 2022, 5 pages.

Canadian Intellectual Property Office Application Serial No. 3,185,268, Office Action dated May 22, 2024, 6 pages.

* cited by examiner

【FIG. 1】
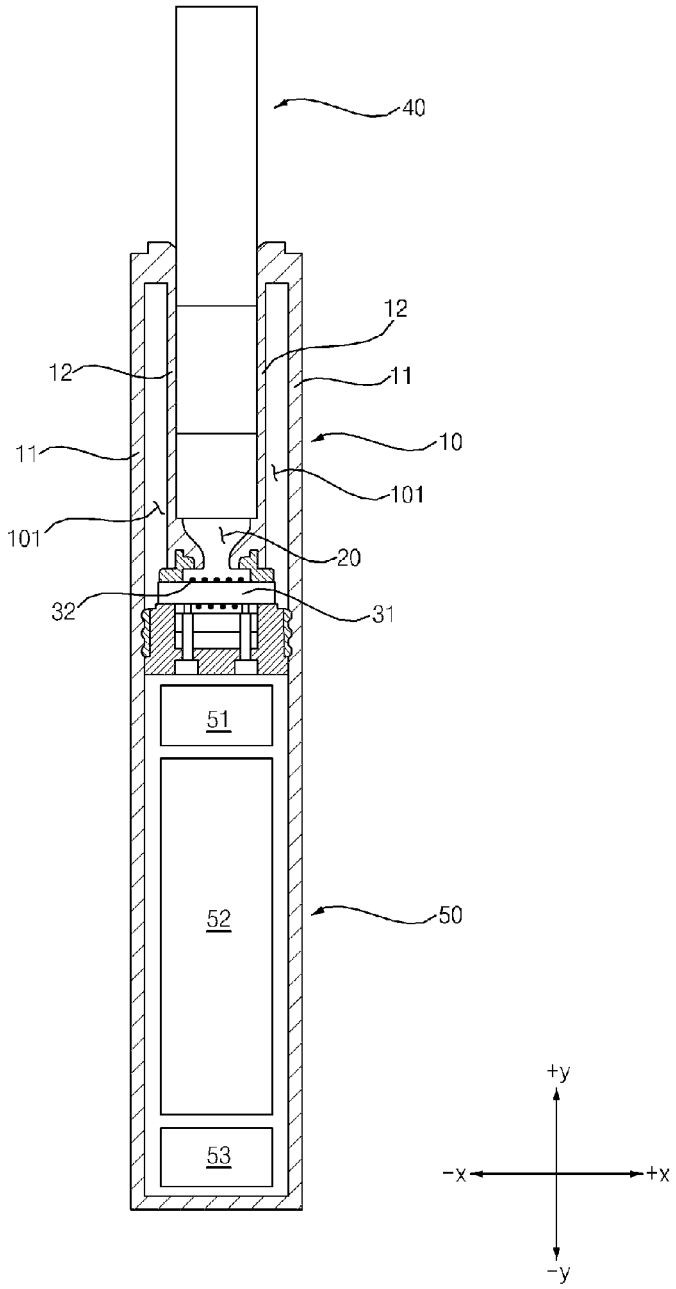

【FIG. 2】
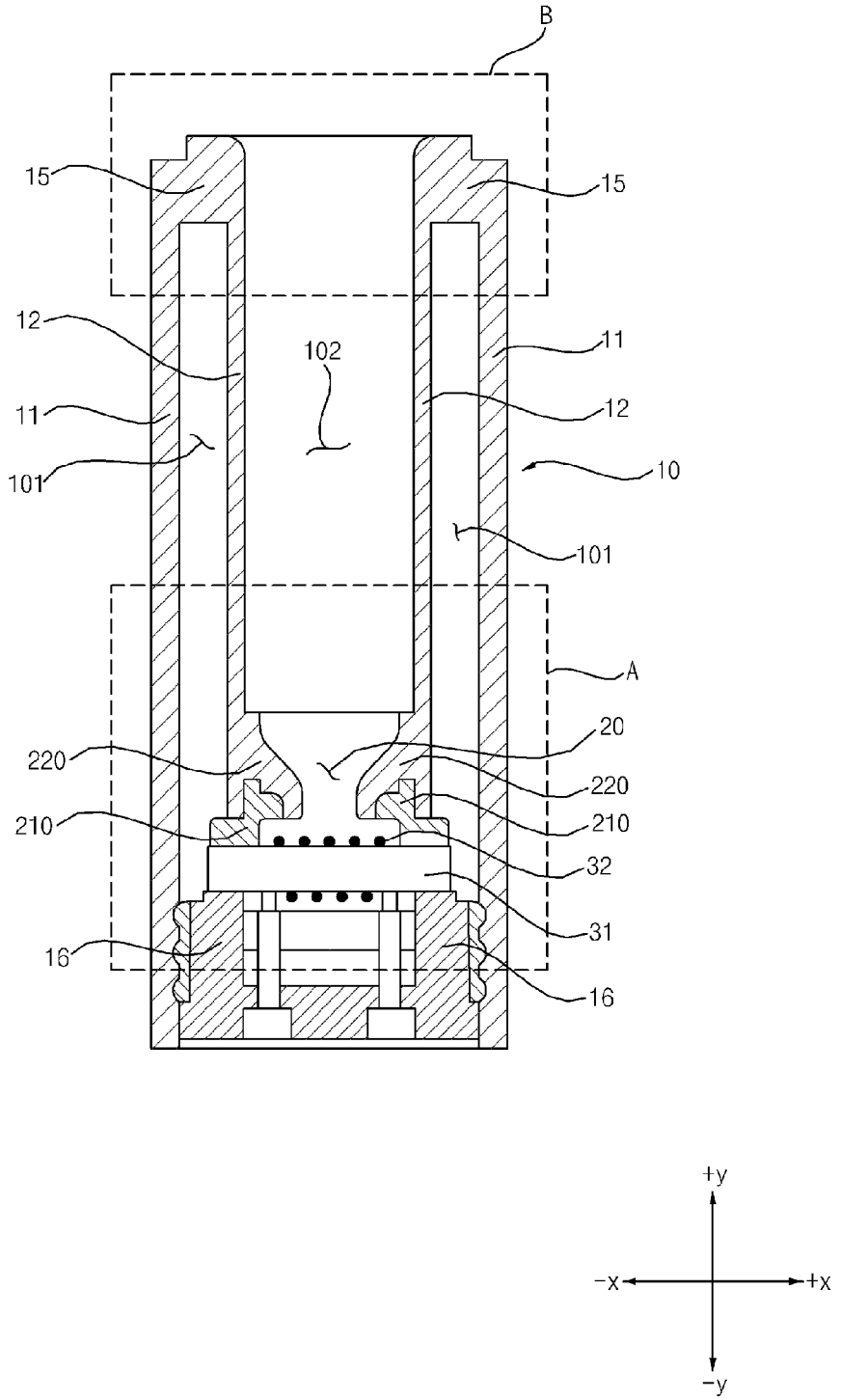

【FIG. 3】
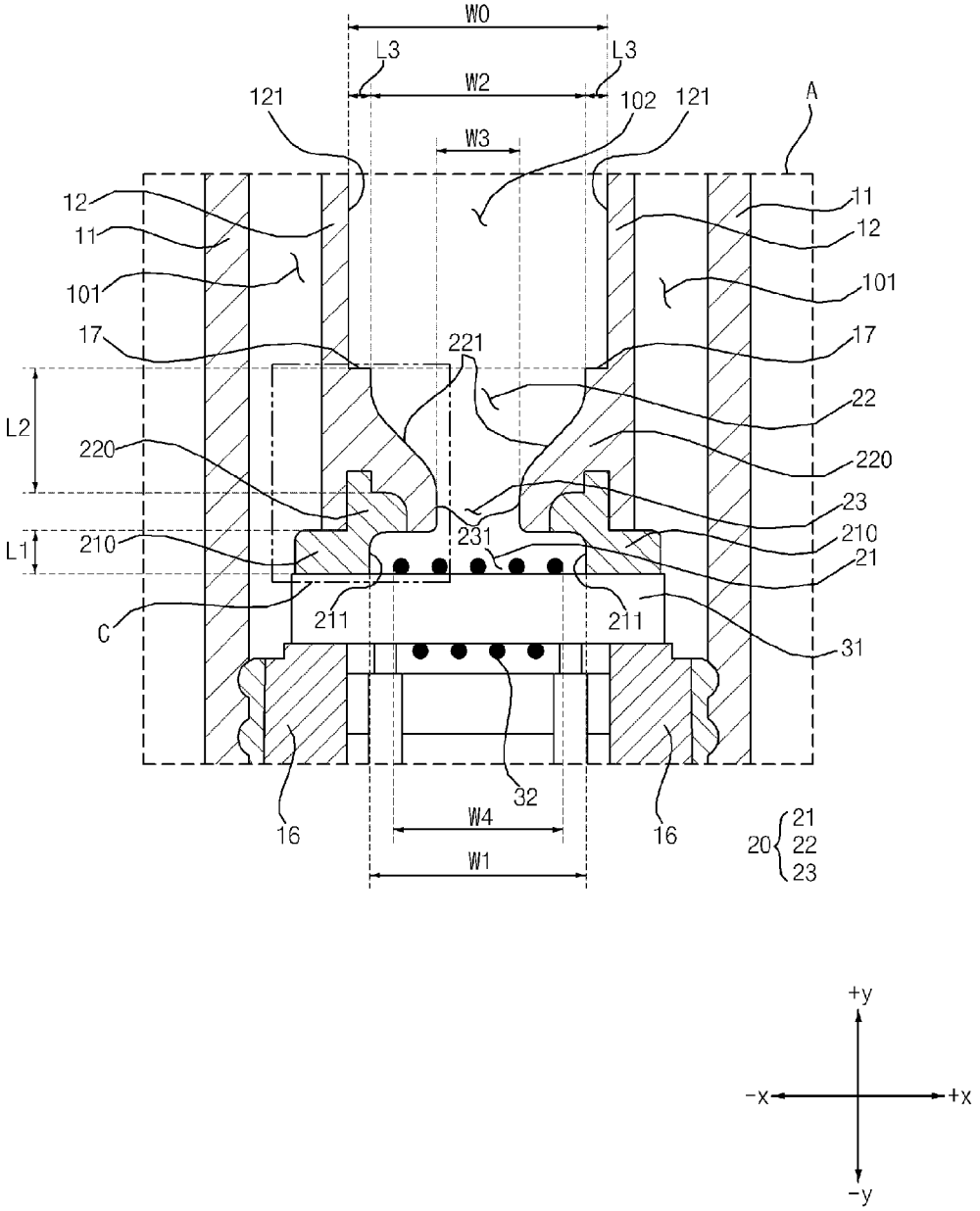

【FIG. 4】
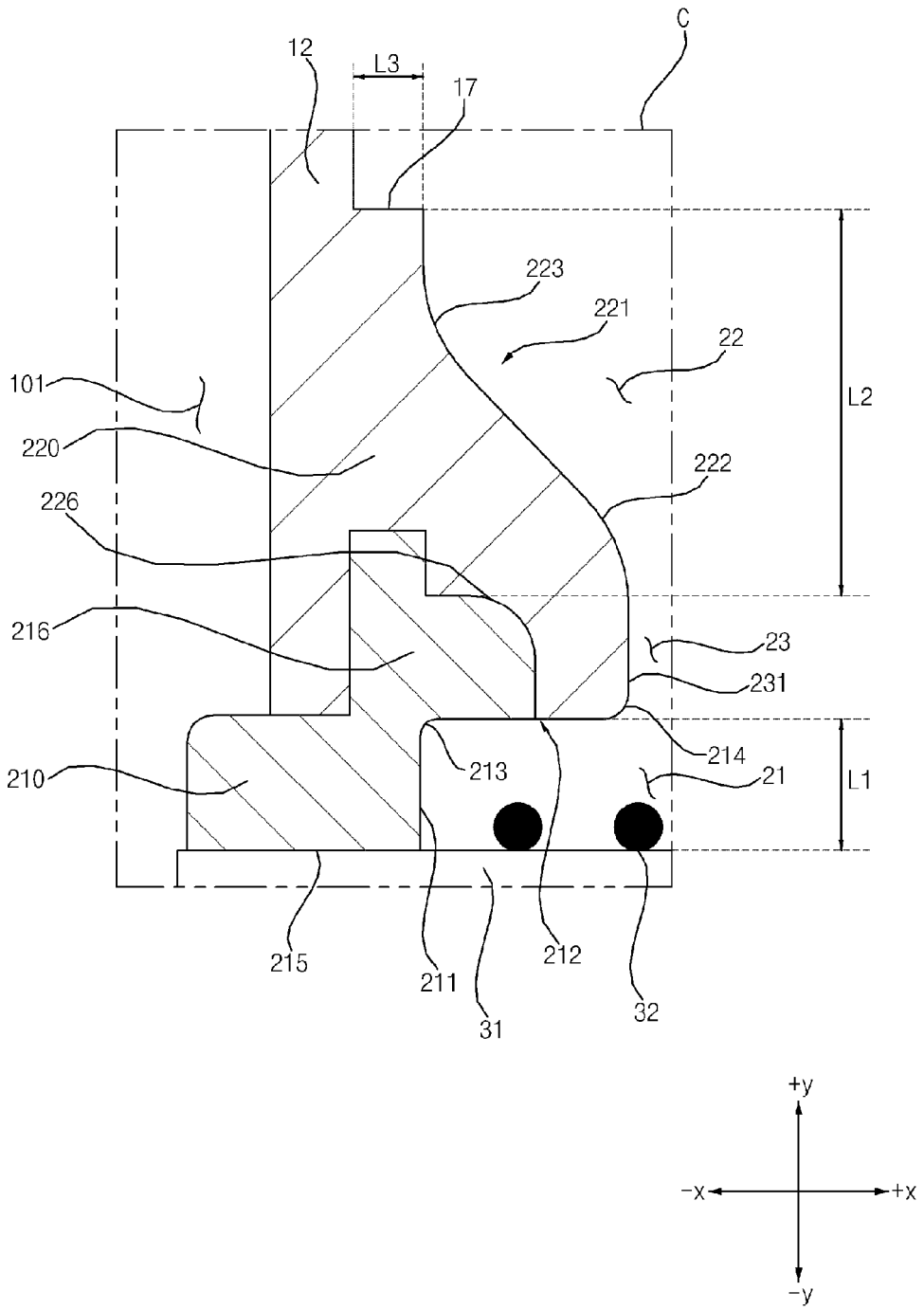

【FIG. 5】
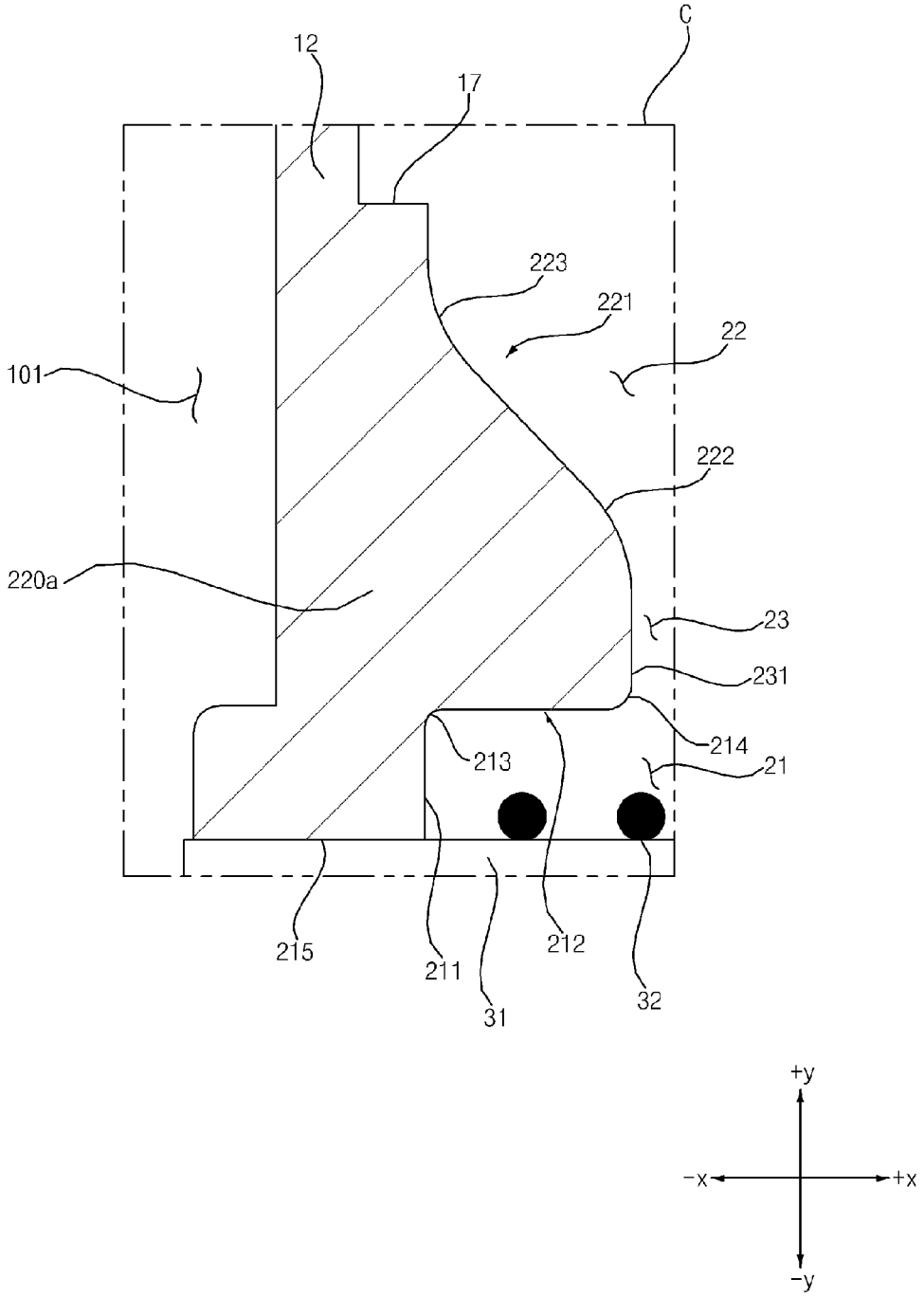

【FIG. 6】
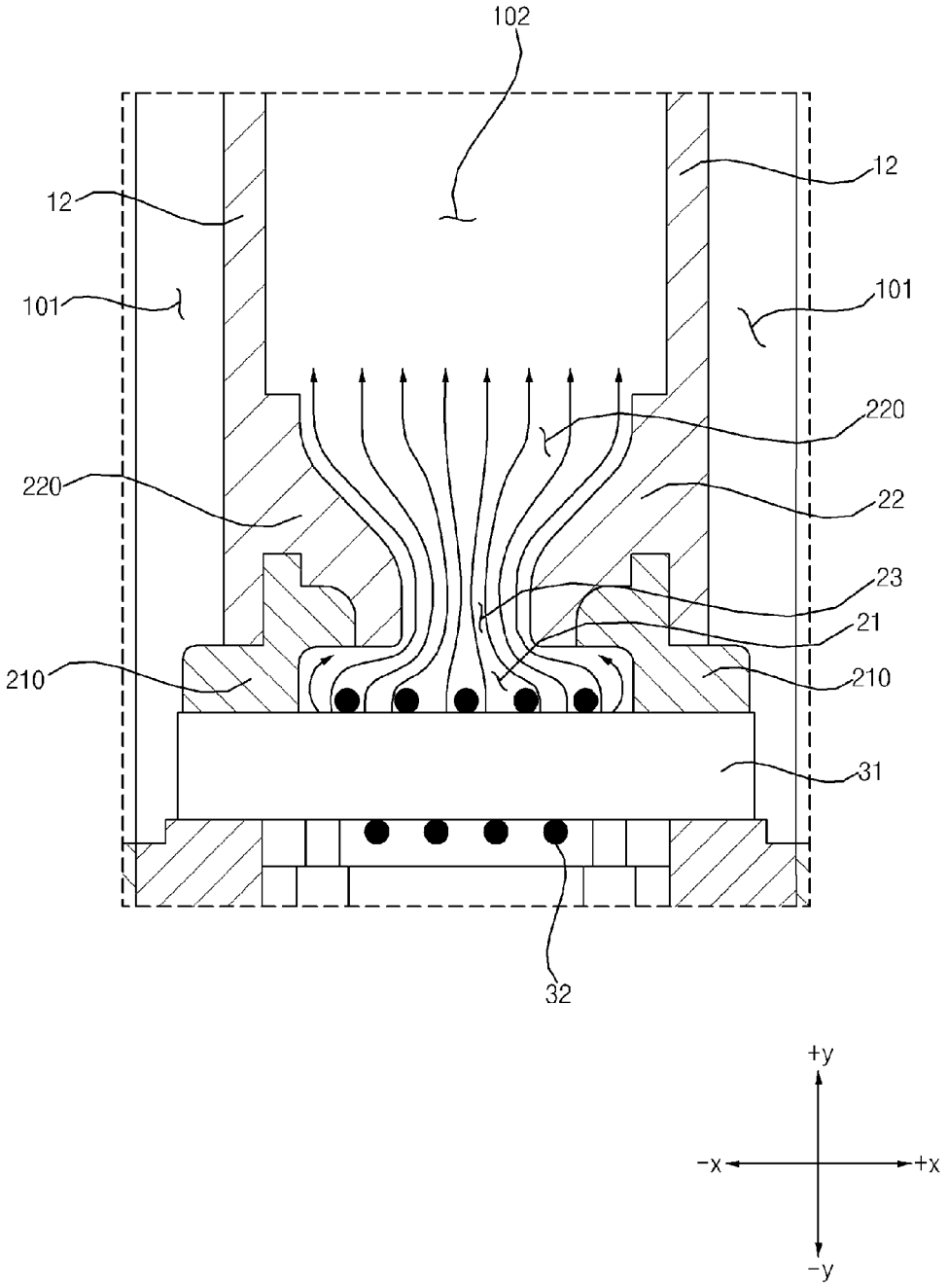

【FIG. 7】
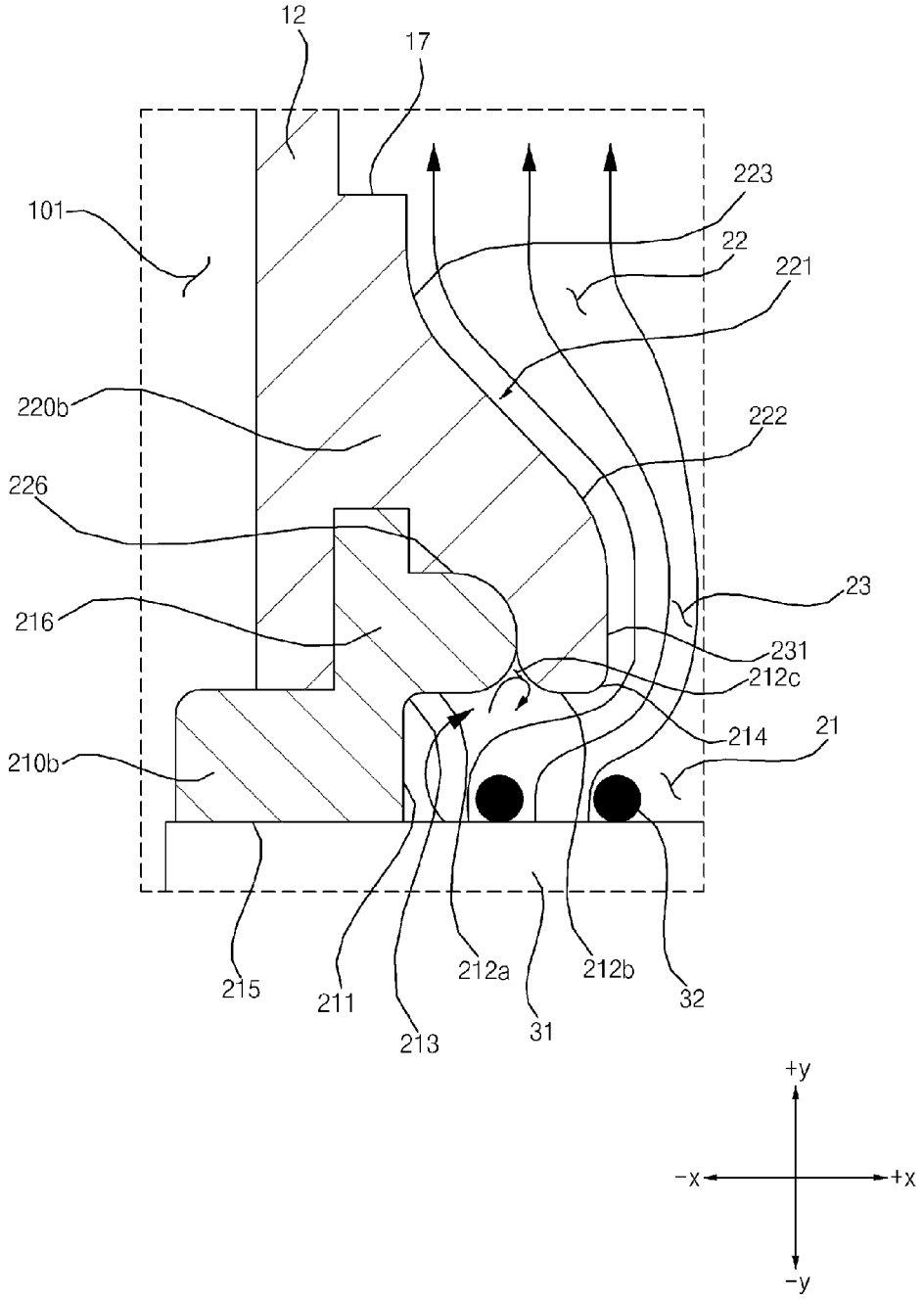

【FIG. 8】
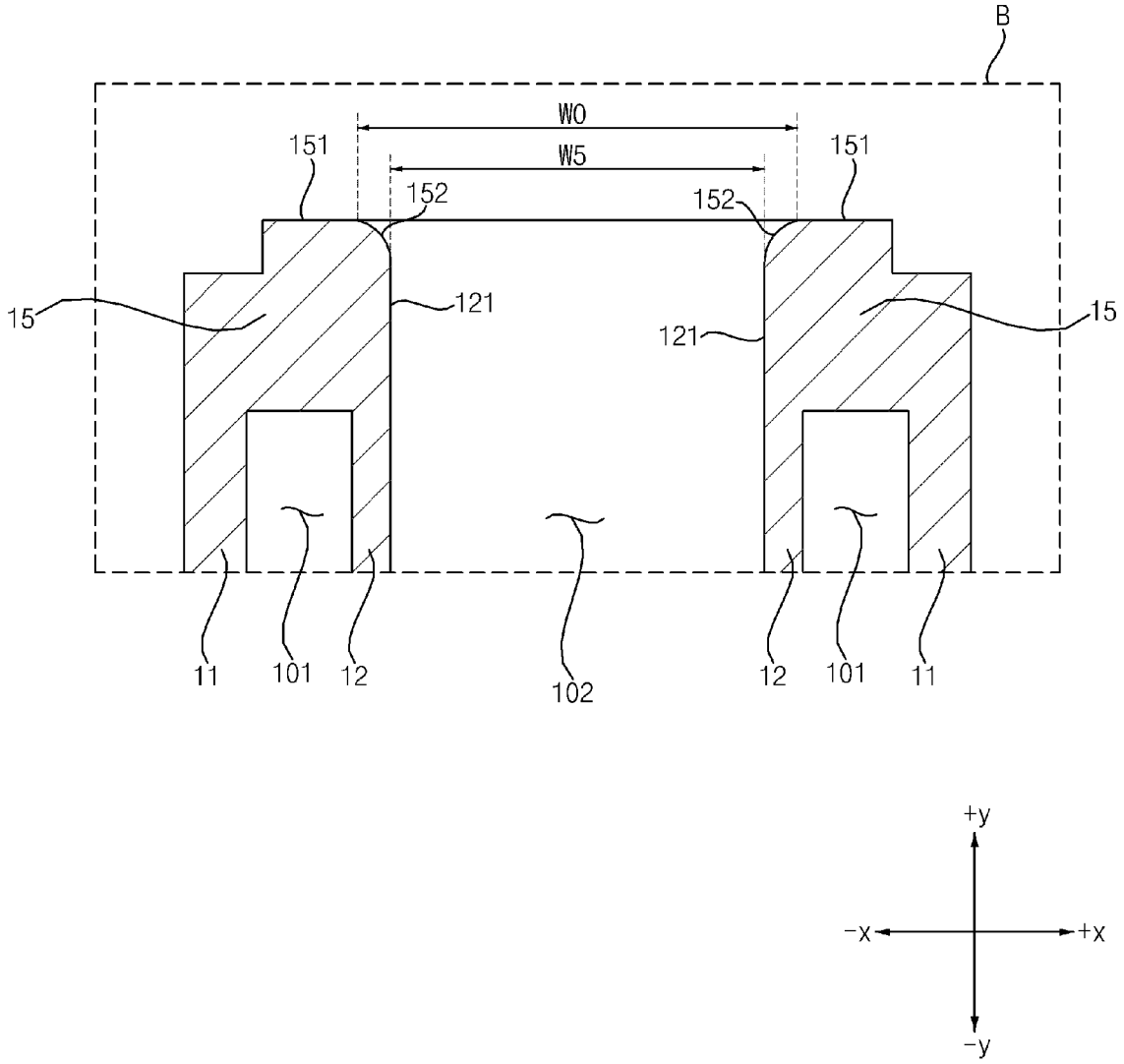

【FIG. 9】
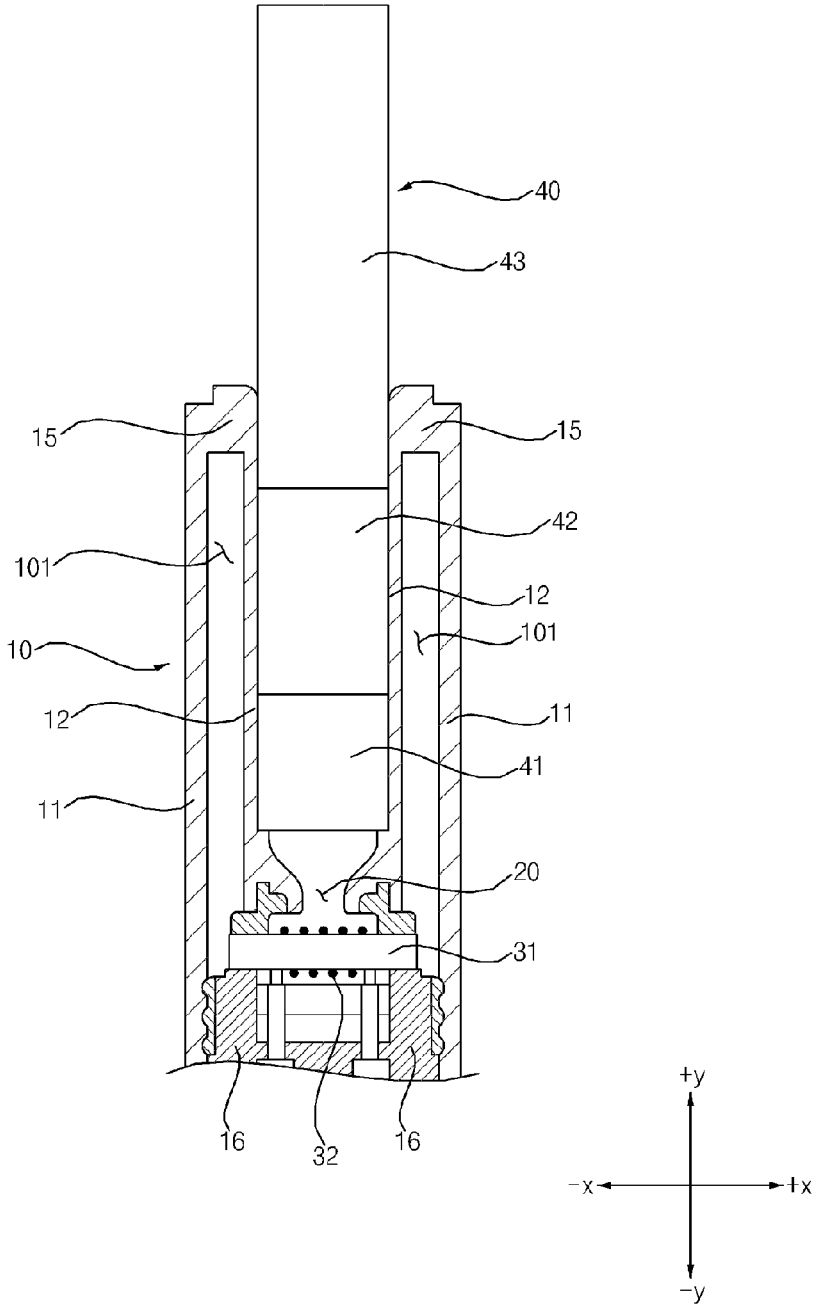

【FIG. 10】
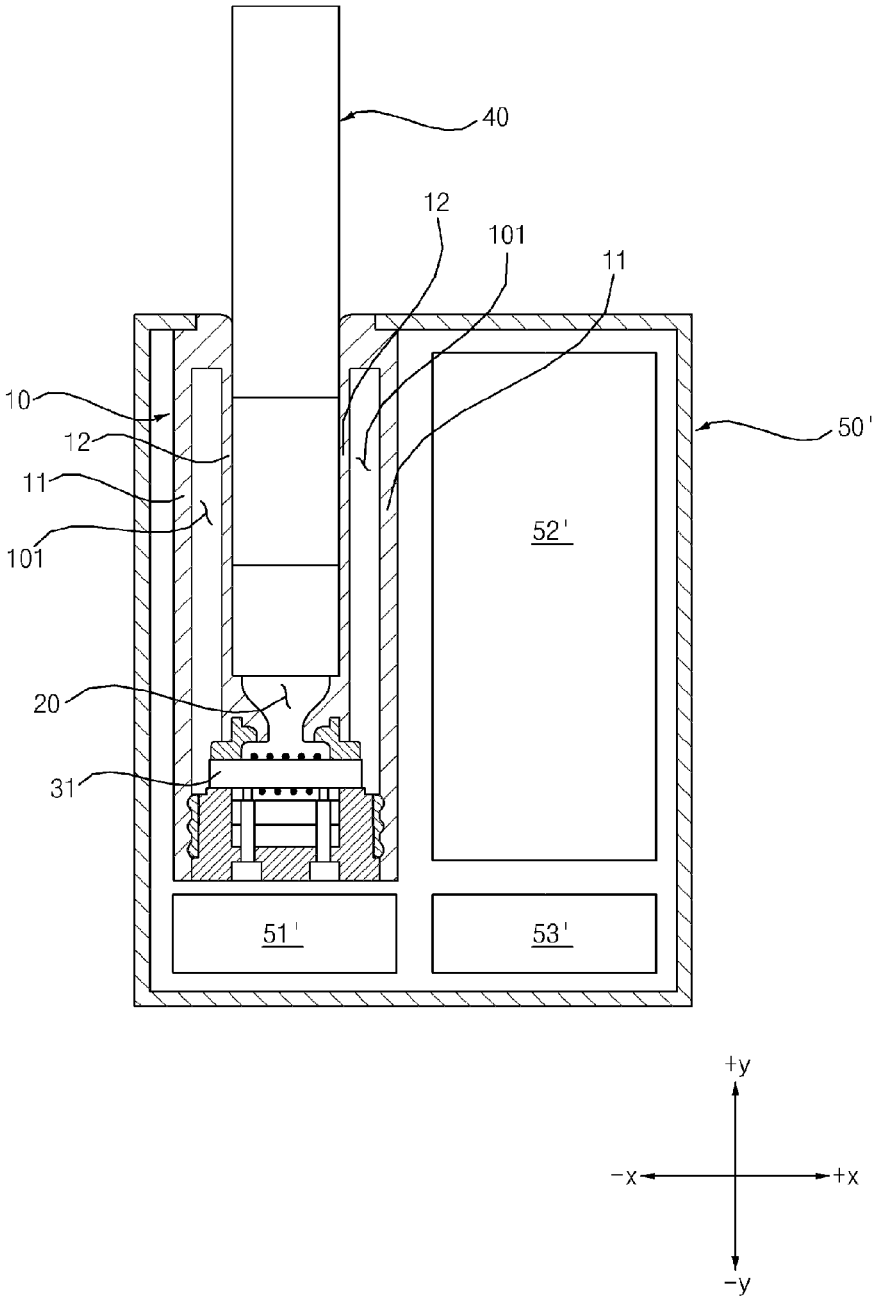

【FIG. 11】
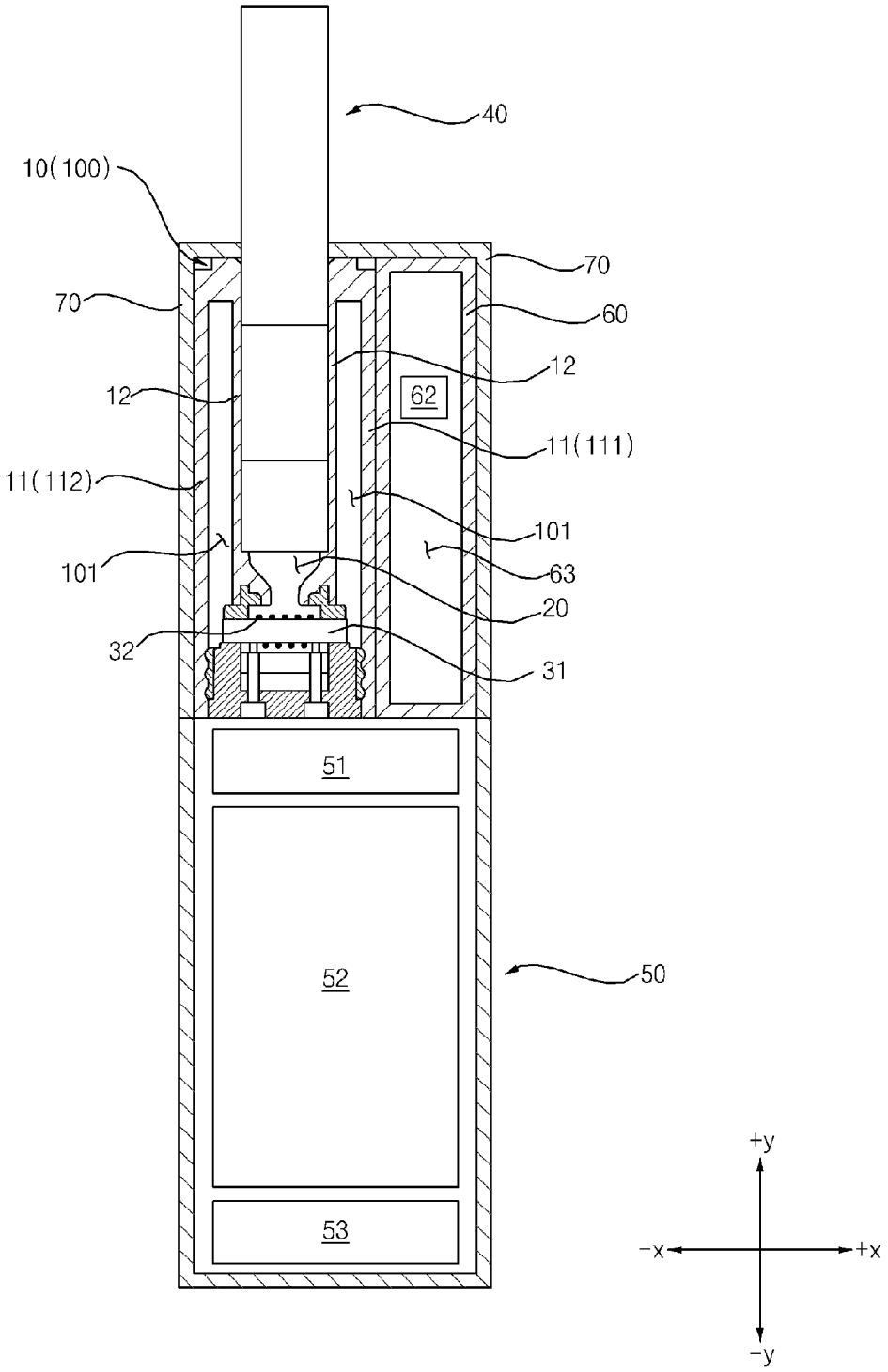

【FIG. 12】
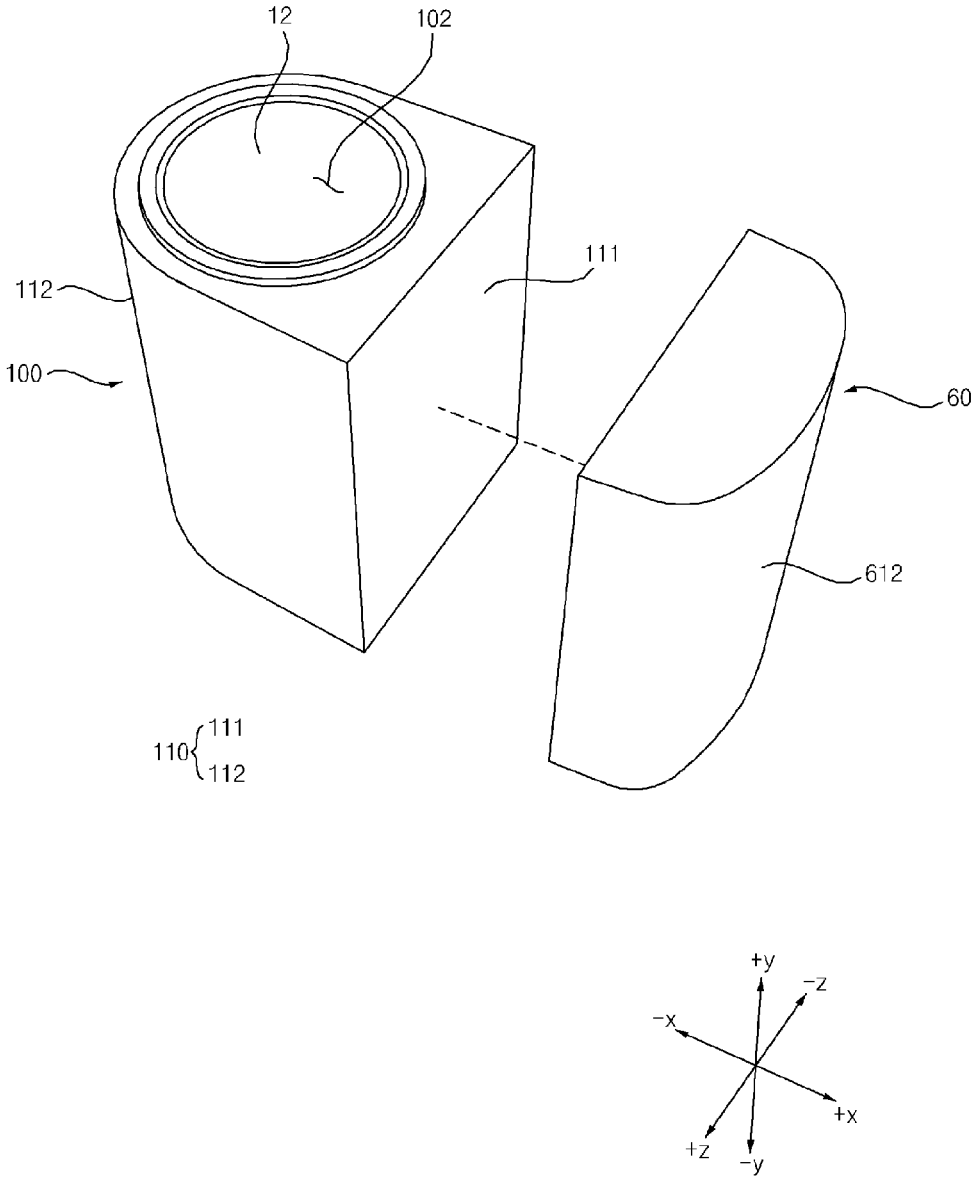

【FIG. 13】
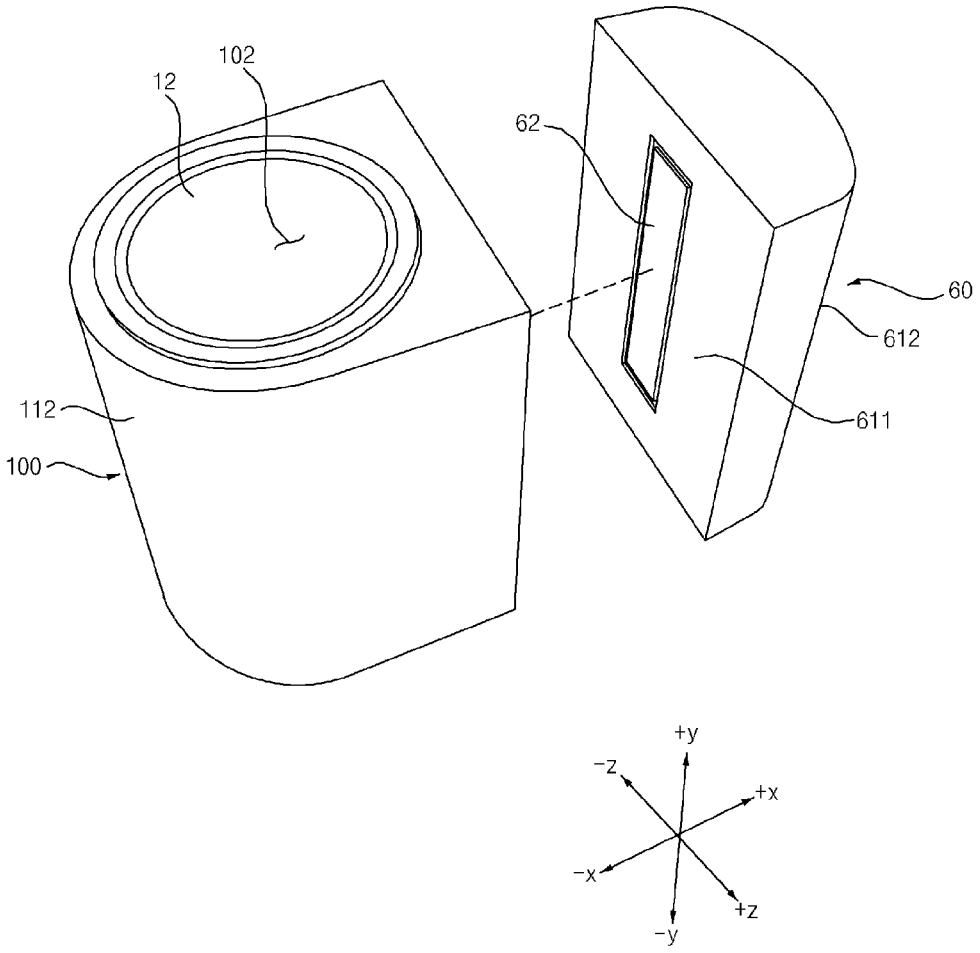

【FIG. 14】
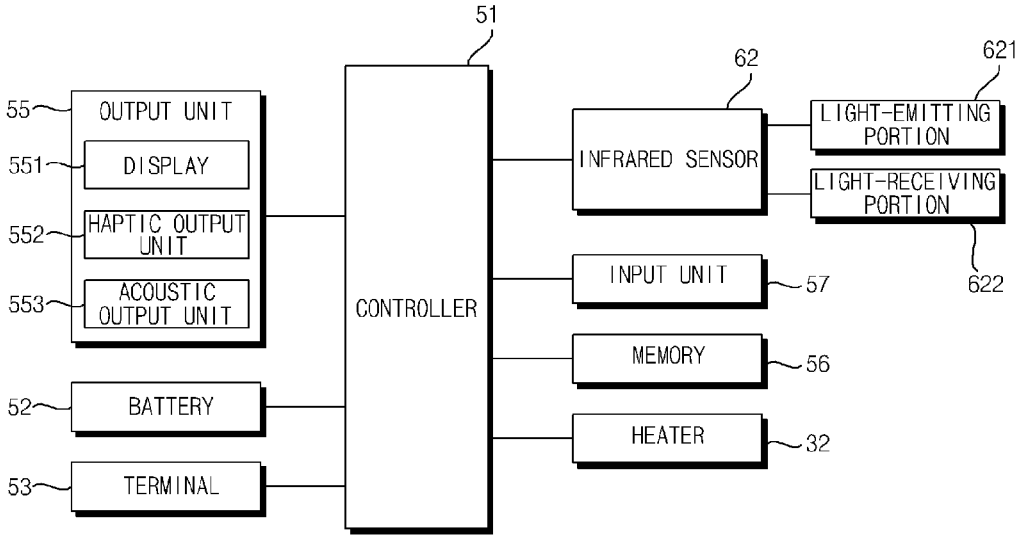

【FIG. 15】
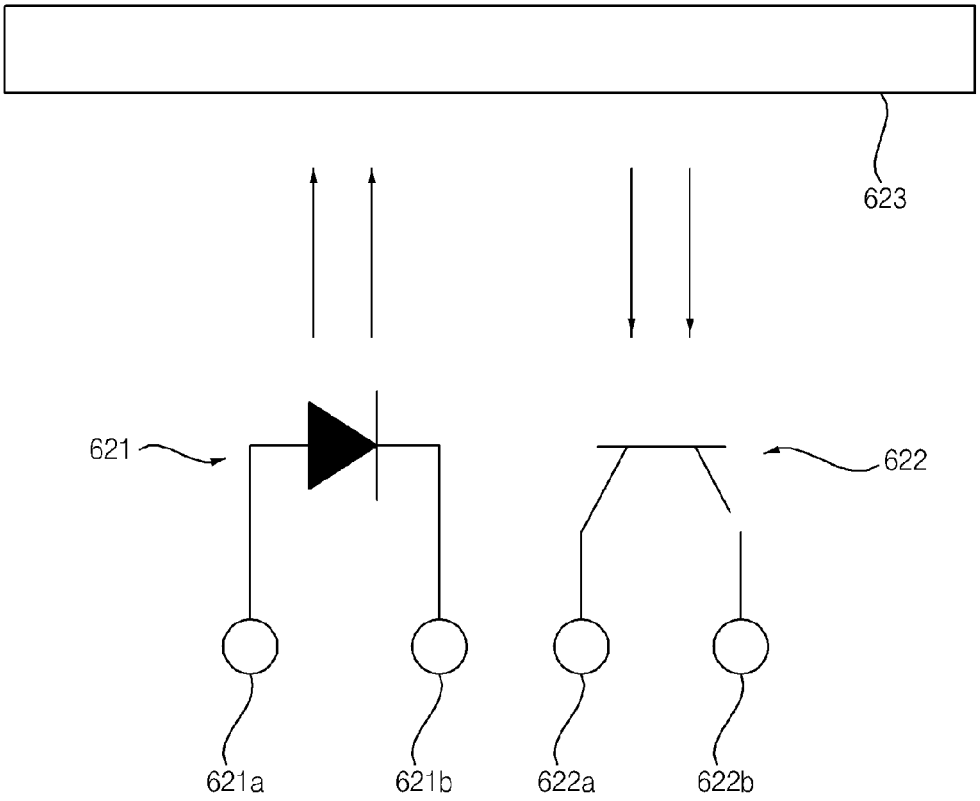

【FIG. 16】
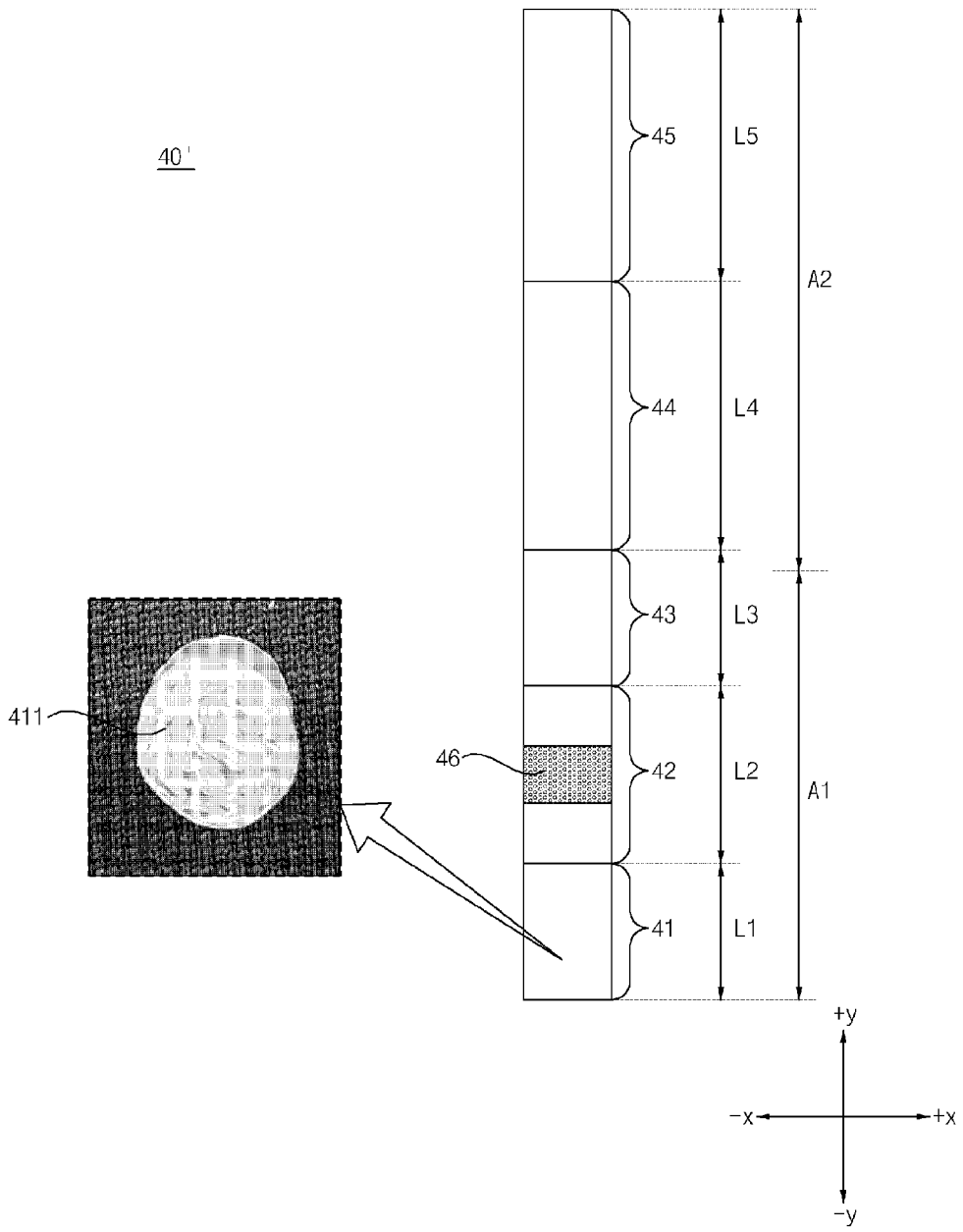

【FIG. 17】
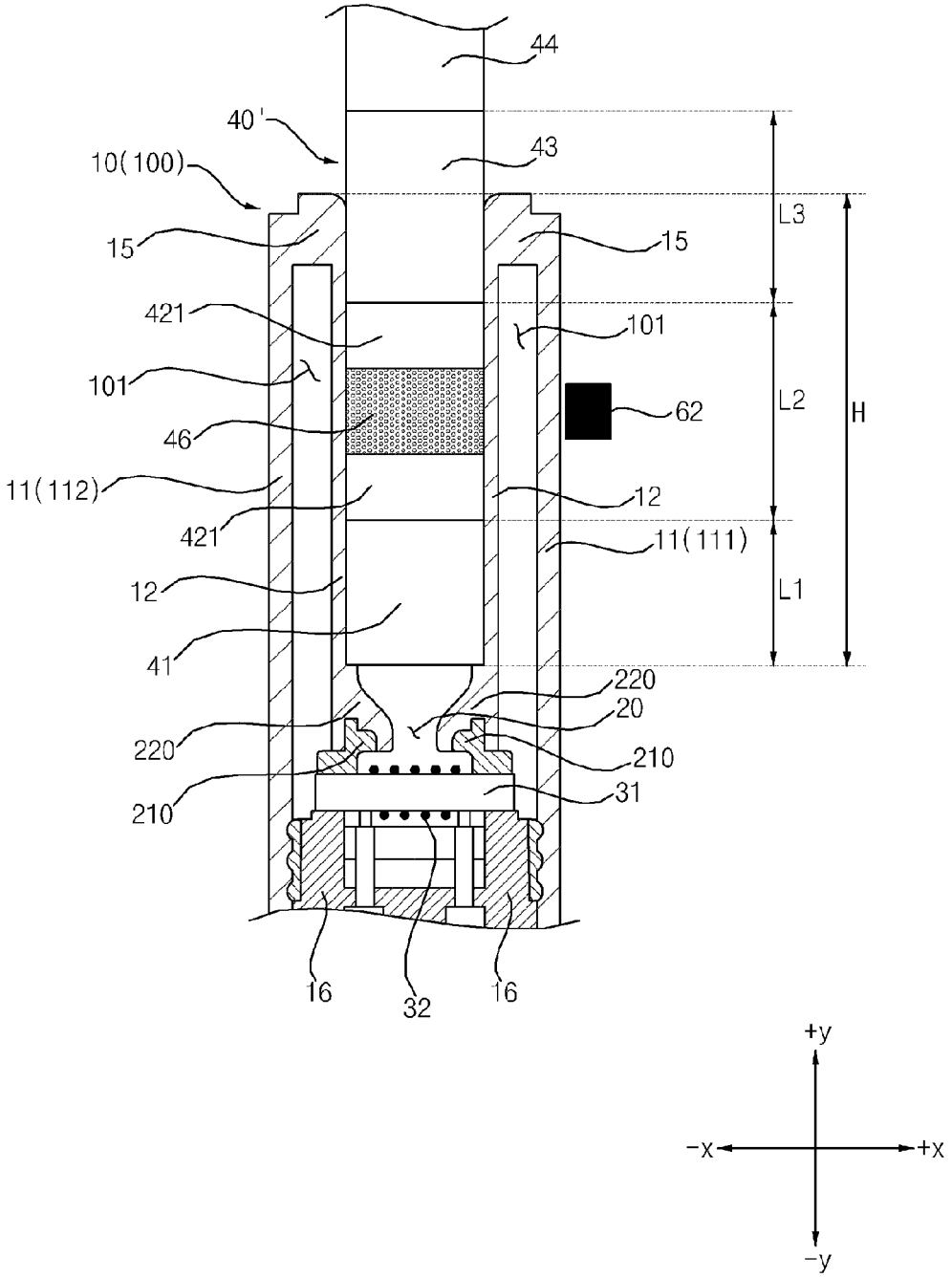

【FIG. 18】
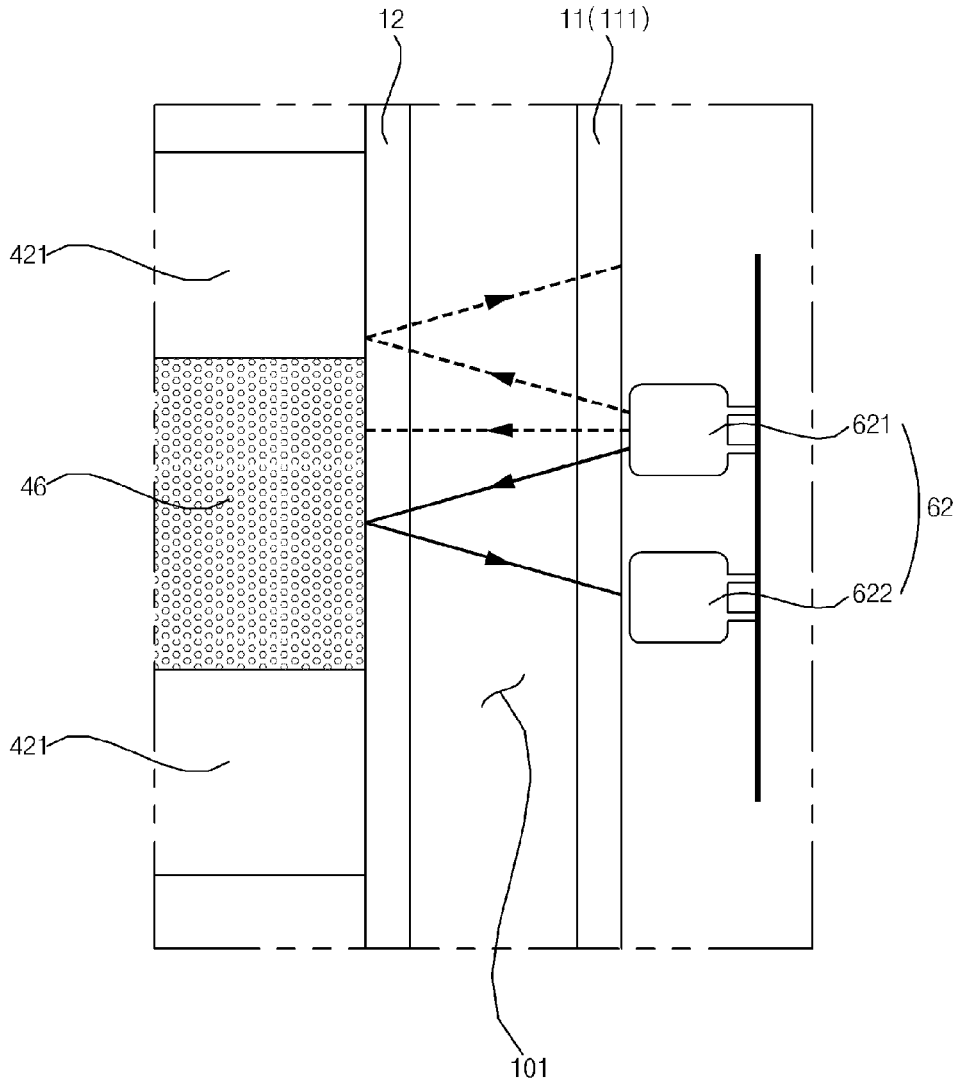

【FIG. 19】
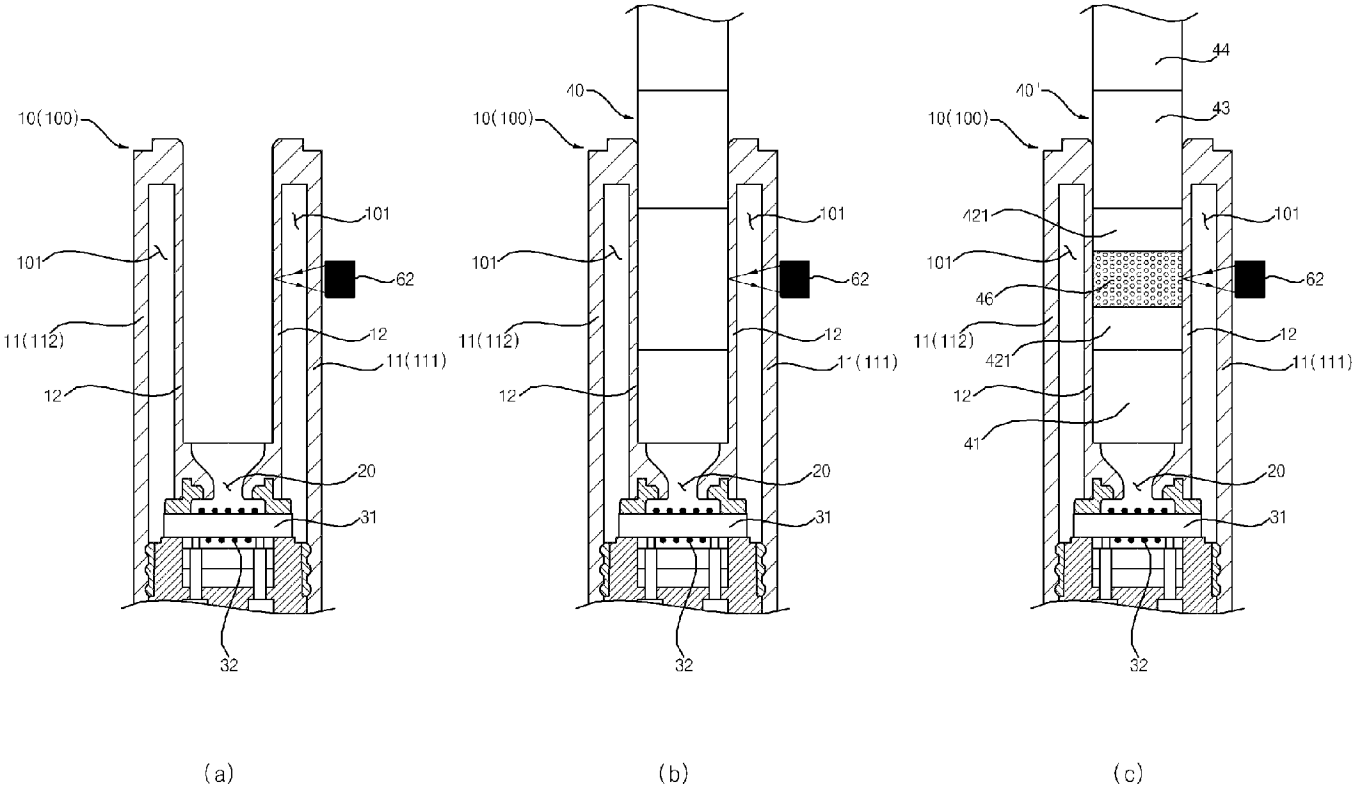

[FIG. 20]
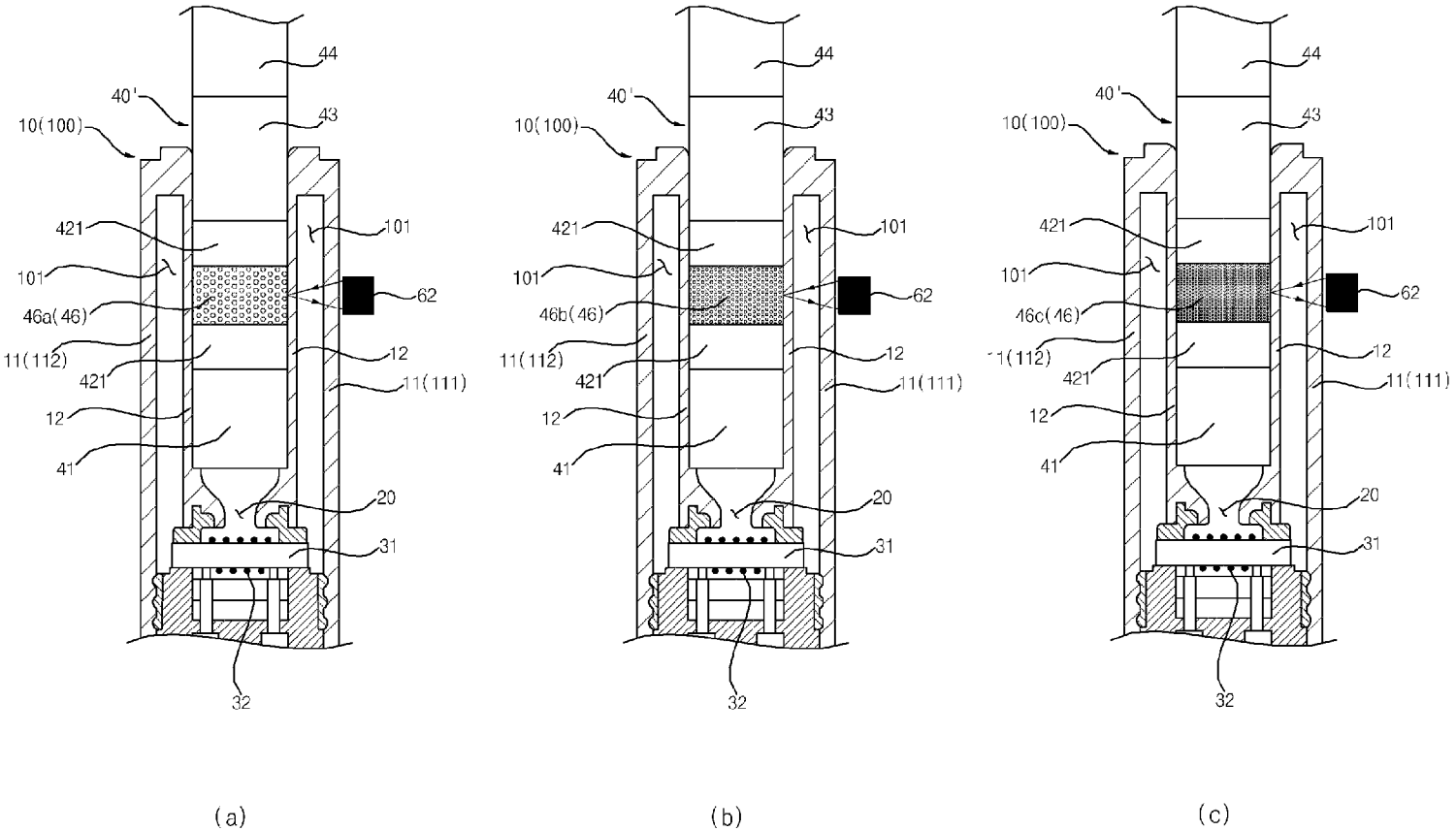

【FIG. 21】
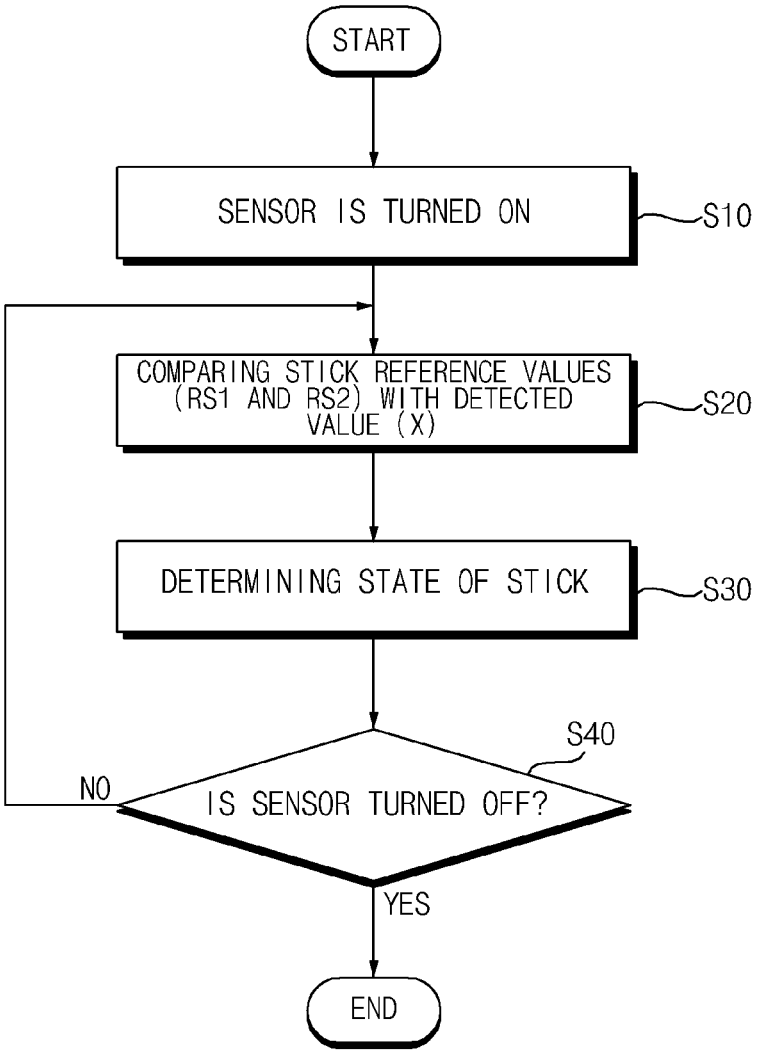

【FIG. 22】
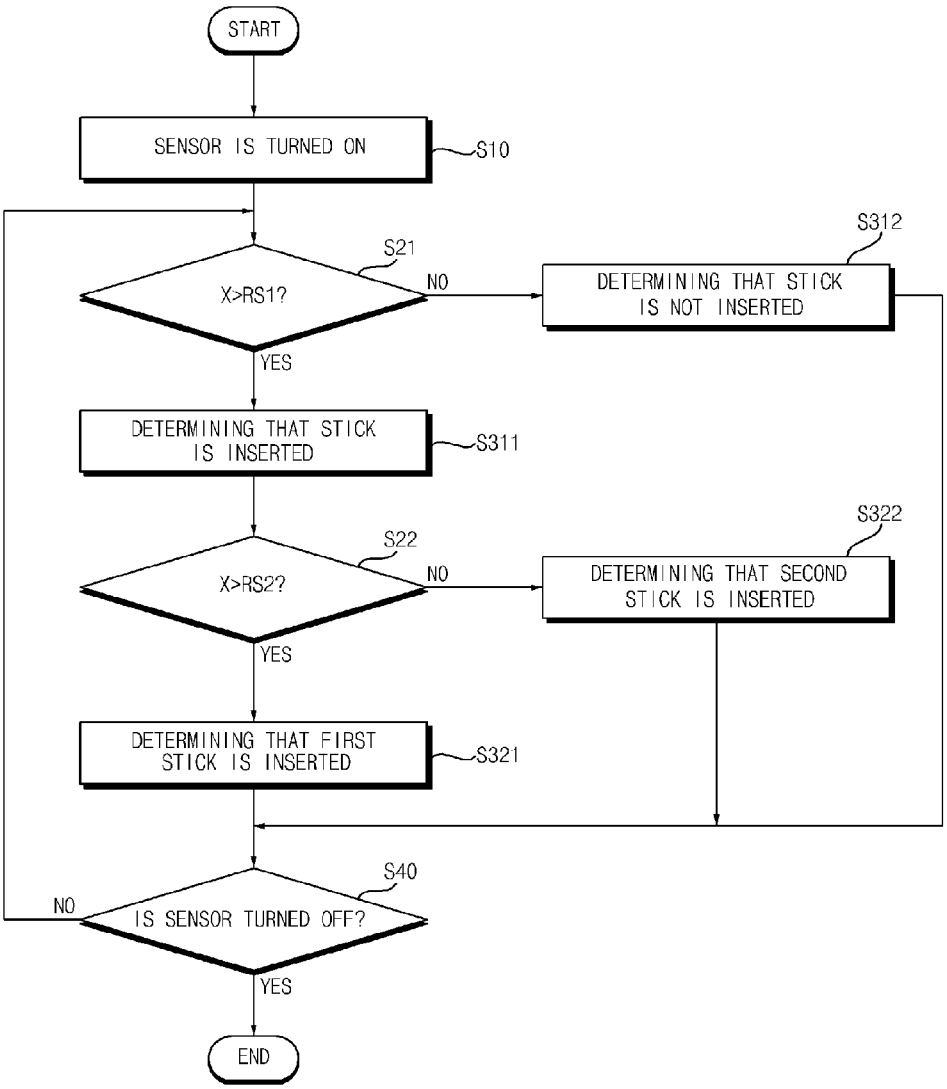

AEROSOL-GENERATING DEVICE

CROSS-REFERENCE TO RELATED APPLICATIONS

This application is the National Stage filing under 35 U.S.C. 371 of International Application No. PCT/KR2022/000368, filed on Jan. 10, 2022, which claims the benefit of earlier filing date and right of priority to Korean Application No. 10-2021-0009173, filed on Jan. 22, 2021, the contents of which are all hereby incorporated by reference herein their entirety.

TECHNICAL FIELD

The present disclosure relates to an aerosol-generating device.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an object of the present disclosure to provide an aerosol-generating device which is improved with regard to efficiency of use of a space configured to store therein liquid.

It is another object of the present disclosure to provide an aerosol-generating device in which a wick and a heater are disposed close to a stick in order to improve the efficiency of heat transfer of aerosol.

It is still another object of the present disclosure to provide an aerosol-generating device which has an increased liquid storage space and is provided at an outer surface of the liquid storage space with a space in which various components, such as a sensor, are disposed, and which is easy for a user to grip.

It is yet another object of the present disclosure to provide an aerosol-generating device which is capable of detecting the state of a stick without invading a space into which a stick is inserted or interfering with inserting of the stick.

Solution to Problem

In accordance with an aspect of the present invention for accomplishing the above and other objects, there is provided an aerosol-generating device including an elongated container comprising an inner wall and an outer wall, wherein the inner wall defines an insert space configured to accommodate insertion of an aerosol-generating member, and wherein a chamber configured to store liquid is defined between the inner wall and the outer wall; a wick disposed at an end of the insert space; a heater configured to heat the wick; a passage formed between the insert space and the wick; and an infrared sensor disposed adjacent to the insert space.

Advantageous Effects of Invention

According to at least one of embodiments of the present disclosure, it is possible to provide an aerosol-generating device which is designed to allow a stick to be inserted into a container having a chamber configured to store therein a liquid, thereby improving the efficiency of use of the space configured to store therein the liquid.

In addition, according to at least one of embodiments of the present disclosure, it is possible to provide an aerosol-generating device which is configured to reduce the distance between a heater, which is configured to heat a wick connected to a chamber storing therein a liquid to thus generate an aerosol, and a stick to thus reduce the flowing distance of aerosol, thereby improving the efficiency of heat transfer for formation of the aerosol.

In addition, according to at least one of embodiments of the present disclosure, the aerosol-generating device is advantageous in that the container having the chamber for storing liquid therein has outer surfaces having different shapes in order to provide spaces in which various components are disposed, to increase a liquid storage space, and to allow the device to be gripped by a user.

In addition, according to at least one of embodiments of the present disclosure, the aerosol-generating device is advantageous in that the sensor is disposed outside the container so as not to invade the inserting space, into which the stick is inserted, or to interfere with inserting of the stick and in that light penetrates thorough the chamber and is reflected so as to detect the state of the stick based on the detected value detected by the sensor.

Additional applications of the present disclosure will become apparent from the following detailed description. However, because various changes and modifications that fall within the spirit and scope of the present disclosure will be readily apparent to those skilled in the art, it should be understood that the detailed description and specific embodiments, including preferred embodiments of the present disclosure, are merely given by way of example.

BRIEF DESCRIPTION OF DRAWINGS

The above and other objects, features and other advantages of the present disclosure will be more clearly understood from the following detailed description taken in conjunction with the accompanying drawings, in which:

FIGS. 1 to 22 are views illustrating an aerosol-generating device according to an embodiment of the present disclosure.

MODE FOR THE INVENTION

A description will now be given in detail according to exemplary embodiments disclosed herein, with reference to the accompanying drawings. For the sake of brevity of description with reference to the drawings, the same or equivalent components are denoted by the same reference numbers, and a description thereof will not be repeated.

In general, suffixes such as "module" and "unit" may be used to refer to elements or components. The use of such suffixes herein is merely intended to facilitate description of the specification, and the suffixes do not have any special meaning or function.

In the present disclosure, that which is well known to one of ordinary skill in the relevant art has generally been omitted for the sake of brevity. The accompanying drawings are used to facilitate understanding of various technical features, and it should be understood that the embodiments presented herein are not limited by the accompanying drawings. As such, the present disclosure should be construed to extend to any alterations, equivalents and substitutes, in addition to those that are particularly set out in the accompanying drawings.

It is to be understood that, although the terms "first," "second," etc. may be used herein to describe various elements, these elements should not be limited by these terms. These terms are only used to distinguish one element from another.

It will be understood that when an element is referred to as being "connected with" another element, intervening elements may be present. In contrast, it will be understood that when an element is referred to as being "directly connected with" another element, there are no intervening elements present.

A singular representation may include a plural representation unless the context clearly indicates otherwise.

Hereinafter, the directions of an aerosol-generating device are defined based on the orthogonal coordinate system shown in FIGS. 1 to 10. In the orthogonal coordinate system, the x-axis direction may be defined as the rightward and leftward directions of the aerosol-generating device. Here, based on the origin, the +x-axis direction may mean the rightward direction, and the −x-axis direction may mean the leftward direction. Furthermore, the y-axis direction may be defined as the upward and downward directions of the aerosol-generating device. Here, based on the origin, the +y-axis direction may mean the upward direction, and the −y-axis direction may mean the downward direction.

Referring to FIG. 1, a container 10 may be configured to extend vertically. The container 10 may have a hollow form. The container 10 may have the form of a cylinder that extends vertically.

The container 10 may include an outer wall 11 and an inner wall 12. The outer wall 11 may extend vertically. The outer wall 11 may extend along the outer periphery of the container 10. The outer wall 11 may extend circumferentially so as to define a cylinder form. The container 10 may extend longitudinally. The "longitudinal direction" of the container 10 may therefore mean the direction in which the container 10 extends. The longitudinal direction of the container 10 may be the vertical direction.

The inner wall 12 may extend vertically. The inner wall 12 may extend along the inner periphery of the container 10. The inner wall 12 may extend circumferentially so as to define a cylinder shape.

The inner wall 12 may be inwardly spaced apart from the outer wall 11. The inner wall 12 may be radially inwardly spaced apart from the outer wall 11. The outer wall 11 and the inner wall 12 may be connected to each other at the upper portions thereof.

A chamber 101 may be defined between the outer wall 11 and the inner wall 12. The chamber 101 may extend vertically. The chamber 101 may extend circumferentially along the outer wall 11 and the inner wall 12. The chamber 101 may have a cylinder shape. Liquid may be stored in the chamber 101.

A passage unit 20 may be formed in an inner and lower portion of the inner wall 12. Sucked air may pass through the passage unit 20.

A wick 31 may be connected to the inside of the chamber 101. The wick 31 may absorb the liquid stored in the chamber 101. The wick 31 may be disposed adjacent to one end of the inserting space 102 in the longitudinal direction of the container 10.

A stick 40 may extend vertically. The stick 40 may have a cylindrical form. The stick 40 may be inserted into the container 10. The stick 40 may be inserted into the inner wall 12 of the container 10. The aerosol that is generated at the wick 31 may be transmitted to the stick 40 through the passage unit 20. the stick 40 may be referred to as an aerosol-generating member 40.

Consequently, the chamber in the container 10, in which the liquid is stored, may surround the stick 40 to improve the efficiency of the liquid storage space.

Accordingly, since the distance between the wick 31, which is connected to the chamber 101, or a heater 32 (see FIG. 2), which is configured to heat the liquid to thus generate aerosol, and the stick 40 is decreased, it is possible to improve the efficiency of heat transmission to the aerosol.

A main body 50 may have a form that extends vertically. The main body 50 may have a hollow form. The main body 50 may have the form of a cylinder that extends vertically.

The container 10 and the main body 50 may be connected to each other. The container 10 may be disposed above the main body 50. The container 10 may be detachably coupled to the main body 50. The container 10 and the main body 50 may form a continuous surface.

A controller 50 may be disposed inside the main body 50. The controller 50 may perform ON/OFF control of the aerosol-generating device. The controller 51 may be electrically connected to the heater 32 (see FIG. 2) so as to perform control to supply power to the heater 32 to thus heat the wick 31. The controller 51 may be disposed below the heater 32. The controller 51 may be disposed adjacent to the heater 32.

A battery 52 may be disposed inside the main body 50. The battery 52 may supply power to the aerosol-generating device. The battery 52 may be electrically connected to the controller 51 and/or a terminal 53. The battery 52 may be disposed below the controller 51. The battery 52 may extend vertically.

The terminal 53 may be disposed at the end of the main body 50. The terminal 53 may be electrically connected to an external power source so as to receive power and transmit the power to the battery 52. The terminal 53 may be disposed at the lower portion of the main body 50. The terminal 53 may be disposed below the battery 52.

Referring to FIG. 2, the inner wall 12 may extend circumferentially and vertically so as to define a inserting space 102 therein. The inserting space 102 may be formed by opening the upper and lower ends of the inside of the inner wall 12. The stick 40 (see FIG. 1) may be inserted into the inserting space 102. The inner wall 12 may be disposed between the chamber 101 and the inserting space 102. The inner wall 12 may define the inserting space.

The inserting space 102 may be configured to have a shape corresponding to the portion of the stick 40 that is inserted into the inserting space 102. The inserting space 102 may extend vertically. The inserting space 102 may have a cylindrical shape. When the stick 40 is inserted into the inserting space 102, the stick 40 may be surrounded by the inner wall 12, and may be in close contact with the inner wall.

The outer wall 11 and the inner wall 12 may be connected to each other via the upper portion 15 of the container 10. The chamber 101 may be defined by the outer wall 11, the inner wall 12, and the upper portion 15 and the lower portion 16 of the container 10.

The wick 31 may be disposed below the inserting space 102. The wick 31 may be disposed below the passage unit 20. The wick 31 may be connected to the chamber 101 so as to absorb the liquid stored in the chamber 101. The wick 31 may be disposed between the inner wall 12 and the lower portion 16 of the container 10. The wick 31 may extend in one direction. The wick 31 may be oriented horizontally.

The heater 32 may be disposed around the wick 31. The heater 32 may wound around the wick 31 in the direction in which the wick 31 extends. The heater 32 may heat the wick. The heater 32 may generate an aerosol from the liquid absorbed in the wick 31 by heating due to electrical resistance thereof. The heater 32 may be connected to the controller 51 (see FIG. 1) so that the supply of power thereto is controlled.

The passage unit 20 may be formed between the inserting space 102 and the wick 31. The aerosol that is generated at the wick 31 may flow toward the inserting space 102 through the passage unit 20. The passage unit 20 may be configured so as to be narrowed and then widened in the direction in which the aerosol flows. The direction in which the aerosol flows may be upwards.

The passage unit 20 may be surrounded by an upper passage wall 220, which projects inwards from the inner wall 12. The upper portion of the passage unit 20 may be surrounded by the upper passage wall 220, and the lower portion of the passage unit 20 may be surrounded by a lower passage wall 210. The lower passage wall 210 may be coupled to the lower portion of the upper passage wall 220. The wick 31 may be disposed between the lower passage wall 210 and the lower portion 16 of the container 10.

Referring to FIG. 3, the passage unit 20 may be divided into a first passage 21, a second passage 22, and a third passage 23.

The first passage 21 may be positioned adjacent to the wick 31. The first passage 21 may be positioned above the wick 31. The second passage 22 may be positioned adjacent to the inserting space 102. The second passage 22 may be connected to the inserting space 102.

The third passage 23 may be positioned between the first passage 21 and the second passage 22. The third passage 23 may be positioned above the first passage 21. The second passage 22 may be positioned above the third passage 23. The third passage 23 may connect the first passage 21 with the second passage 22.

The width W3 of the third passage 23 may be less than the width W1 of the first passage 21. The width W3 of the third passage 23 may be less than the width W2 of the second passage 22. The maximum width of the first passage 21 and the maximum width W2 of the second passage 22 may be equal to each other or almost equal to each other. The maximum width W1 of the first passage 21 may be greater than the maximum width W2 of the second passage 22. The width W2 of the second passage 22 may be less than the width W0 of the inserting space 102.

The passage unit 20 may be narrowed toward the third passage 23 from the first passage 21. The passage unit 20 may be widened toward the second passage 22 from the third passage 23. The width W2 of the second passage 22 may gradually increase toward the inserting space 102.

As a result, aerosol may be collected in the third passage 23, which has a small width, from the first passage 21, and may then diffuse through the second passage 22. Accordingly, even when aerosol is not uniformly generated at the wick 31, the aerosol may be uniformly introduced toward the lower portion of the stick 40 (see FIGS. 1 and 6).

The width W1 of the first passage 21 may decrease toward the third passage 23. The width W2 of the second passage 22 may decrease toward the third passage 23.

The extent to which the width W1 of the first passage 21 decreases toward the third passage 23 may be steeper than the extent to which the width W2 of the second passage 22 decreases toward the third passage 23. The distance L1 between the maximum width W1 of the first passage 21 and the width W3 of the third passage 23 may be less than the distance L2 between the maximum width W2 of the second passage 22 and the width W3 of the third passage 23. In other words, variation in the width relative to the length may be greater toward the third passage 23 from the first passage 21 than toward the third passage 23 from the second passage 22.

Assuming that the horizontal width of the first passage 21 is W1, the horizontal width of the second passage 22 is W2, the horizontal width of the third passage 23 is W3, the vertical length of the first passage 21 is L1, and the vertical length of the second passage 22 is L2, the relationship $(W1-W3)/(L1)>(W2-W3)/(L2)$ may be established thereamong.

The vertical length L1 of the first passage 21 may be less than the vertical length L2 of the second passage 22 ($L1<L2$).

Accordingly, a space for guiding atomized liquid toward the third passage 23 may be ensured while the length of the first passage 21 is reduced, and the aerosol that is collected in the third passage 23 may flow into the inserting space 102 through the second passage 22 while uniformly diffusing (see FIG. 6).

The vertical length of the third passage 23 may be less than the vertical length L1 of the first passage 21. The vertical length of the third passage 23 may be less than the vertical length L2 of the second passage 22.

The second passage 22 may be configured such that the horizontal width W2 thereof continually increases moving toward the inserting space 102 and is then maintained at a substantially constant width W2 from the point of the maximum width W2 toward the inserting space 102.

The first passage 21 may be surrounded by a first passage surface 211. The second passage 22 may be surrounded by a second passage surface 221. The third passage 23 may be surrounded by a third passage surface 231.

The first passage surface 211 may define the inner surface of the lower passage wall 210. The second passage surface 221 and the third passage surface 231 may define the inner surface of the upper passage wall 220.

The first passage surface 211 and the third passage surface 231 may be spaced apart from each other rather than defining a continuous surface. The first passage surface 211 may extend circumferentially. The first passage surface 211 may be configured to have a ring shape.

The first passage 21 may extend toward the third passage 23 while maintaining substantially the same width W1, and may be steeply narrowed to the width W3 of the third passage 23 near the third passage 23.

Consequently, since the space in the first passage 21 is provided between the first passage surface 211 and the wick 31, aerosol may be efficiently generated and may easily flow in the portion between the first passage surface 211 and the wick 31.

The third passage surface 231 and the second passage surface 221 may define a continuous surface. The third passage surface 231 may extend vertically. The third passage surface 231 may extend circumferentially. The third passage surface 231 may have a ring shape.

The second passage surface 221 may include a portion that extends toward the inserting space 102 while being increasingly widened radially outwards. The second passage surface 221 may include a portion that is inclined radially outwards toward the inserting space 102. The second passage surface 221 may include a portion that extends toward the inserting space 102 while being increasingly widened radially outwards. The second passage surface 221 may be configured to have the approximate shape of a funnel or venturi shape.

The second passage surface 221 may extend toward the inserting space 102 from the third passage surface 231 while being increasingly widened outwards, and may then extend toward the inserting space 102 from the point of maximum width W2 while maintaining the substantially constant width W2.

The second passage surface 221 may include a portion that extends toward the inserting space 102 while being rounded outwards. The second passage surface 221 may extend upwards from the third passage surface 231 while being rounded radially outwards.

Consequently, the resistance to flow may be reduced when the aerosol diffuses toward the second passage 22 from the third passage 23.

The width W2 of the second passage 22 may be the greatest at the upper end of the second passage 22, which meets the lower end of the inserting space 102. The width W2 of the upper end of the second passage 22 may be less than the width W0 of the inserting space 102.

A stepped surface 17 may be positioned between the lower end of the inserting space 102 and the upper end of the second passage 22. The stepped surface 17 may project inwards from the inner wall 12 of the container 10. The stepped surface 17 may support the periphery of the lower end of the stick 40. The stepped surface 17 may project inwards, and may define the maximum width W2 of the second passage 22.

The stepped surface 17 may constitute the upper surface of the upper passage wall 220, which projects inwards from the inner wall 12. The stepped surface 17 may extend substantially perpendicularly to the inner surface 121 of the inner wall 12. The stepped surface 17 and the inner surface 121 may face the inserting space 102. The second passage surface 221 may extend downwards from the stepped surface 17.

The projecting length L3 of the stepped surface 17 may be preferably determined such that the stepped surface 17 supports the lower end of the stick 40 (see FIG. 1) and such that impedance to flow of aerosol is minimized.

The wick 31 may be oriented so as to extend in the width direction of the first passage 21, and the heater 32 may be wound around the wick 31 in the direction in which the wick 31 extends.

The width W1 of the first passage 21 may be greater than the width W4 of the heater 32. The width W3 of the third passage 23 may be less than the width W4 of the heater 32. When the container 10 extends vertically, the width direction of the passage unit 20 may be a rightward and leftward direction.

Accordingly, even when a deviation in the amount of aerosol occurs at the aerosol-generating portion of the wick 31 when the heater 32 heats the liquid absorbed in the wick 31 to generate aerosol, the aerosol may be collected in the third passage 23, and may uniformly diffuse toward the inserting space 102 from the second passage 22.

Referring to FIGS. 3 and 4, a first bent zone 222 and a second bent zone 223, which are formed on the second passage surface 221, may be bent so as to be reversely convex.

The first bent zone 222 may be formed on a lower portion of the second passage surface 221. The first bent zone 222 may be formed adjacent to the third passage 23. The first bent zone 222 may be bent so as to be convex in the inward direction of the container 10 from the third passage surface 231.

The second bent zone 223 may be formed on the upper portion of the second passage surface 221. The second bent zone 223 may be formed adjacent to the inserting space 102. The second bent zone 223 may be bent so as to be convex in the outward direction of the container 10 from the first bent zone 222. The second bent zone 223 may be bent so as to be convex in the outward direction of the container 10, and may include a portion that is positioned adjacent to the inserting space 102 and extends toward the inserting space 102 while maintaining a substantially constant width.

Consequently, aerosol may diffuse outwards along the first bent zone 222 of the second passage surface 221, and may be introduced straight into the inserting space 102 along the second bent zone 223 of the second passage surface 221 (see FIG. 6).

Accordingly, it is possible to reduce the impedance to flow of the aerosol that diffuses toward the second passage 22 from the third passage 23.

The upper passage wall 220 may extend downwards from the inner wall 12. The upper passage wall 220 may be configured so as to project inwards from the inner wall 12. The second passage surface 221 and the third passage surface 231 may define the inner surface of the upper passage wall 220.

The lower passage wall 210 may be coupled to the lower portion of the upper passage wall 220. The first passage surface 211 may define the inner surface of the lower passage wall 210.

A groove 226 may be formed in the lower portion of the upper passage wall 220. The groove 226 may be formed upwards as a depression in the lower portion of the upper passage wall 220.

The inserting portion 216 may be formed at the upper portion of the lower passage wall 210. The inserting portion 216 may be formed above the first passage surface 211.

The inserting portion 216 may be formed so as to project upwards from the upper portion of the lower passage wall 210. The inserting portion 216 may be inserted into the groove 226 so as to be in close contact therewith. When the inserting portion 216 is inserted into the groove 226, the upper passage wall 220 and the lower passage wall 210 may be coupled to each other. The lower passage wall 210 may be removably coupled to the lower portion of the upper passage wall 220.

The lower passage wall 210 may define the width W1 (see FIG. 3) of the first passage 21. The width W1 of the first passage 21 may vary depending on the extent to which the first passage surface 211, which defines the inner surface of the lower passage wall 210, is depressed in rightward and leftward directions.

The closer the first passage surface 211 of the lower passage wall 210 is formed to the axis, the narrower the width W1 of the first passage 21. The farther away from the axis the first passage surface 211 of the lower passage wall 210 is formed, the greater the width W1 of the first passage 21. Accordingly, the width W1 of the first passage 21 may be determined or changed by inserting the lower passage wall 210, having a specific size, into the upper passage wall 220.

As a result, the area of the wick 31 in which liquid is atomized may be determined by changing the length W1 of the portion of the wick 31 (see FIG. 3) that is exposed to the first passage 21 and the width W4 of the portion of the heater 32 (see FIG. 3) that is wound around the wick 31.

The first passage surface 211 may extend vertically. The first passage surface 211 may be formed substantially perpendicular to the wick 31. The first passage surface 211 may define the length L1 of the first passage 21.

An extended surface 212 may constitute a portion of the inner surface of the upper passage wall 220 and a portion of the inner surface of the lower passage wall 210. The extended surface 212 may be formed between the first passage surface 211 and the third passage surface 231.

The extended surface 212 may be connected to the upper end of the first passage surface 211. The extended surface 212 may be connected to the lower end of the third passage surface 231. The extended surface 212 may extend horizontally from the upper end of the first passage surface 211. The extended surface 212 may extend horizontally from the lower end of the third passage surface 231.

The extended surface 212 may be spaced upwards apart from the wick 31. The extended surface 212 may be oriented in the width direction of the first passage 21. The extended surface 212 may extend toward the third passage 23 from the upper end of the first passage surface 211. The extended surface 212 may connect the first passage surface 211 to the third passage surface 231. The extended surface 212 may be spaced apart from the wick 31, and may face the wick 31.

The distance between the extended surface 212 and the wick 31 may be substantially the same as the height L1 of the first passage 21. The extended surface 212 may be oriented so as to face the wick 31, with the first passage 21 interposed therebetween. The extended surface 212 may be oriented substantially parallel to the wick 31. The extended surface 212 may be formed substantially perpendicularly to the first passage surface 211. The extended surface 212 may be formed substantially perpendicularly to the third passage surface 231.

The end of the first passage 21 may be surrounded by the first passage surface 211, the wick 31, and the extended surface 212. The aerosol that is atomized at the end of the wick 31 may stagnate at the end of the first passage 21.

Accordingly, a space in which the aerosol that is atomized at the end of the wick 31 is collected may be formed, and the suction force may easily act on the end of the wick 31.

Here, because turbulent flow occurs at the end of the first passage 21 due to the aerosol that is atomized at the end of the wick 31, it is possible to uniformly mix the aerosol even when variation in the amount of aerosol occurs at the aerosol-generating portion of the wick 31 (see FIG. 6).

A first edge portion 213 may be formed between the first passage surface 211 and the extended surface 212. The first edge portion 213 may abut the edge portion of the upper end of the first passage 21. The first edge portion 213 may extend toward the extended surface 212 from the first passage surface 211 while being rounded.

A second edge portion 214 may be formed between the extended surface 212 and the third passage surface 231. The second edge portion 214 may be formed between the first passage 21 and the third passage 23. The second edge portion 214 may extend toward the third passage surface from the extended surface 212 while being rounded.

Consequently, it is possible to reduce the impedance to flow of the aerosol that diffuses toward the third passage 23 from the first passage 21.

A wick-inserting surface 215 may define the lower end of the lower passage wall 210. The wick-inserting surface 215 may extend in the width direction of the first passage 21. The wick-inserting surface 215 may define an opening corresponding to the shape of the end of the wick 31 such that the wick 31 is inserted into the opening. The wick-inserting surface 215 may be connected to the first passage surface 211.

The wick 31 may be inserted between the wick-inserting surface 215 and the lower portion 16 of the container 10. When the wick 31 is inserted, the wick-inserting surface 215 may be in direct contact with the upper end of the wick 31. The wick-inserting surface 215 may be in close contact with the wick 31, thereby preventing outward leakage of liquid.

Referring to FIG. 5, the upper passage wall 220 (see FIG. 4) and the lower passage wall 210 (see FIG. 4), which have been described above, may be integrally formed so as to form a passage wall 220*a*, rather than being coupled to each other. The passage wall 220*a* may have substantially the same shape as the shape of the combined body in which the upper passage wall 220 is coupled to the lower passage wall 210.

Consequently, a process of coupling the components to each other may be omitted, thereby preventing leakage of liquid through a gap between coupled components.

Referring to FIG. 7, a first extended surface 212*a* may constitute a portion of the inner surface of a lower passage wall 210*b*. The first extended surface 212*a* may abut the first passage 21. The first extended surface 212*a* may be connected to the upper end of the first passage surface 211. The first extended surface 212*a* may extend horizontally from the upper end of the first passage surface 211. The first edge portion 213 may be formed between the first passage surface 211 and the first extended surface 212*a*.

A second extended surface 212*b* may constitute a portion of the inner surface of an upper passage wall 220*b*. The second extended surface 212*b* may abut the first passage 21. The second extended surface 212*b* may be connected to the lower end of the third passage surface 231. The second extended surface 212*b* may extend horizontally from the lower end of the third passage surface 231. The second edge portion 214 may be formed between the first extended surface 212*b* and the third passage surface 231.

A recess 212*c* may be formed between the first extended surface 212*a* and the second extended surface 212*b* so as to be depressed upwards to a predetermined depth. The recess 212*c* may be formed between the lower passage wall 210*b* and the upper passage wall 220*b*. The recess 212*c* may face the upper portion of the first passage 21.

Consequently, because more turbulent flow occurs at a position adjacent to the recess 212*c* due to the aerosol that is atomized at the end of the wick 31, it is possible to uniformly mix the aerosol even when variation in the amount of aerosol occurs at the aerosol-generating portion of the wick 31.

Referring to FIG. 8, the upper portion 15 of the container 10 may be formed at the upper sides of the outer wall 11 and the inner wall 12 so as to connect the outer wall 11 to the inner wall 12. The upper portion 15 of the container 15 may cover the upper side of the chamber 101. The upper portion 15 of the container 10 may extend circumferentially to surround the inserting space 102.

The inner surface 121 of the container 10 may constitute the inner surfaces of the inner wall 12 and the upper portion 15. The inner surface 121 of the container 10 may extend vertically.

A sloped surface 152 may be formed between the upper end surface 151 and the inner surface 121 of the container 10 so as to connect the upper end surface 151 to the inner surface 121. The sloped surface 152 may extend to the inner surface 121 from the upper end surface 151 of the container 10 while being gently curved. The sloped surface 152 may extend to the upper end surface 151 from the inner surface 121 while being increasingly enlarged radially outwards. The sloped surface 152 may be inclined outwards such that the opening defined by the sloped surface 152 is narrowed moving downwards. The inner surface 121, the upper end surface 151, and the sloped surface 152 may form a continuous surface.

The width W0 of the lower end of the sloped surface 152 may be less than the width W5 of the upper end of the sloped surface 152. The width W0 of the lower end of the sloped surface 152 may be substantially the same as the width W0 of the inner surface 121.

Consequently, it is easy to insert the stick 40 into the inserting space 102.

Referring to FIG. 9, a plug 41 is disposed at the lower portion of the stick 40. A filter portion 43 may be disposed at the upper portion of the stick 40. A granular portion 42 may be disposed between the plug 41 and the filter portion 43 in the stick 40. A medium may be contained in the granular portion 42.

A user may inhale air in the state of holding the filter portion 43 of the stick 40, inserted into the container 10, in his/her mouth. When the user inhales air through the stick 40, the aerosol that is generated at the wick 31 may be introduced into the granular portion 42 through the passage unit 20 and the plug 41. The aerosol introduced into the granular portion 42 may contain the medium in the granular portion, and may be introduced into the filter portion 43, thereby being filtered therethrough. The filtered air may be supplied to the user.

Referring to FIG. 10, a main body 50' may extend horizontally. The container 10 may be coupled to the right side or the left side of the main body 50'. The container 10 may be coupled to the interior of the main body 50'.

A controller 51' may be disposed in the main body 50'. The controller 51' may be disposed below the heater 32. The controller 51' may be disposed adjacent to the heater 32.

A battery 52' may be disposed in the main body 50'. The battery 52' may be disposed on one side surface of the container 10. The battery 52' may extend vertically along the container 10.

A terminal 53' may be disposed in the main body 50'. The terminal 53' may be disposed adjacent to the controller 51' and the battery 52'.

Referring to FIG. 11, an upper housing 60 may be disposed adjacent to the container 10 or 100. The upper housing 60 may be disposed adjacent to one side surface of the outer wall 11 or 110. The upper housing 60 may be formed so as to be integrally coupled to the main body 50. The upper housing 60 may be disposed above the main body 50. The upper housing 60 and the container 10 or 100 may be disposed parallel to each other above the main body 50.

The container 10 or 100 may be formed so as to be replaceable. The container 10 or 100 may be detachably coupled to the upper end surface of the main body 50 and to one surface of the upper housing 60.

The upper housing 60 may have a reception space 63 defined therein. A sensor 62 may be disposed in the reception space 63 in the upper housing 60. Various components may be disposed in the reception space 63 in the upper housing 60.

The sensor 62 may be disposed outside the outer wall 11 or 111. The sensor 62 may be disposed so as to face the outer wall 11 or 110. The sensor 62 may detect the light emitted from inside the container 100.

The controller 51 may be electrically connected to the sensor 62. The controller 51 may control the operation of the sensor 62. The controller 51 may receive the information obtained by the sensor 62. The controller 51 may determine the information about the stick based on the information obtained by the sensor 62.

The outer wall 11 or 110 and the inner wall 12 may be made of a light-permeable material. The outer wall 11 or 110 and the inner wall 12 may be preferably made of a material having low optical reflectivity and optical refraction index and high light transmissivity. The outer wall 11 or 110 and the inner wall 12 may be made of a plastic material for a light sensor. The outer wall 11 or 110 and the inner wall 12 may be made of polyethylene, polystyrene, Teflon, or the like. However, the material constituting the outer wall 11 or 110 and the inner wall 12 is not limited thereto.

A cover 70 may be disposed above the main body 50. The cover 70 may be disposed outside the container 10 or 100 and the upper housing 60 so as to surround the container 10 or 100 and the upper housing 60. The outer surface of the cover 70 may be flush with the outer surface of the main body 50. The outer surface of the cover 70 may form a surface continuous with the outer surface of the main body 50. The outer surface of the cover 70 may be positioned on an imaginary plane extending from the outer surface of the main body 50.

The cover 70 may be detachably coupled to the upper side of the main body 50. The container 10 or 100 may be replaceable in the state in which the cover 70 is removed. Referring to FIGS. 12 and 13, the z-axis direction may be defined as the forward-and-backward direction of the aerosol-generating device. Based on the origin, the +z-axis direction may mean the forward direction, and the −z-axis direction may mean the backward direction.

The container 100 may be configured so as to extend vertically. The container 100 may have a hollow form. The container 100 may have a right surface that is flat and extends vertically.

The container 100 may include the outer wall 110. The outer wall 110 may be spaced apart from the inner wall 12. The outer wall 110 may extend vertically along the outer periphery of the container 100.

A first surface 111 may be formed at the right side of the outer wall 110. The first surface 111 may extend vertically.

A second surface 112 may be formed at the left side of the outer wall 112. The second surface 112 may be positioned opposite the first surface 111.

The first surface 111 and the second surface 112 may have different shapes. The second surface 112 may be rounded so as to be convex outwards. The first surface 111 may not be rounded. The first surface 111 may have a flat portion. The first surface 111 may have a portion that extends in an up-and-down direction and/or in a forward-and-backward direction.

The upper housing 60 may be formed adjacent to the first surface 111. The upper housing 60 may be disposed so as to face the first surface 111. The upper housing 60 may be in contact with the container 100.

A third surface 611 may be formed on the left surface of the upper housing 60. The third surface 611 may be disposed adjacent to the first surface 111, and may face the first surface 111. The third surface 611 may extend vertically. The third surface 611 may be configured to have a shape corresponding to the first surface 111, and may be in contact with the first surface 111. The third surface 611 may include a portion that extends in an up-and-down direction and/or in a forward-and-backward direction. The first surface 111 and the third surface 611 may be configured to be parallel to each other.

A fourth surface 612 may be formed on the right surface of the upper housing 60. The fourth surface 612 may be positioned opposite the third surface 611. The fourth surface 612 may be rounded so as to be convex outwards.

The sensor 62 may be disposed in the upper housing adjacent to the third surface 611 of the upper housing 60. A portion of the sensor 62 may be exposed to the outside from the upper housing 60. The sensor 62 may be exposed from the third surface 611. The sensor 62 may be disposed so as to face the first surface 111.

Consequently, it is easy for a user to grip the aerosol-generating device, and it is possible to increase the volume of the chamber 101 (see FIG. 11), thereby increasing the size of a liquid storage space and ensuring sufficient space to accommodate the sensor 62.

Referring to FIG. 14, a vibration motor 54 may transmit various information pertaining to, for example, ON/Off of the power supply, activation or deactivation of the heater 32, the state of the stick and the state of the liquid, by means of vibration. The controller 51 may be electrically connected to the vibration motor 54. The controller 51 may control the vibration motor 54 to transmit the various information, which is received from components, to a user by means of vibration.

A user may input various commands, such as ON/OFF of the power supply and the operation of the heater 32, via an input unit 57. The controller 51 may be electrically connected to the input unit 57. The controller 51 may control the operation of the components in response to the commands transmitted from the input unit 57.

An output unit 55 may display various information about ON/OFF of the power supply, activation or deactivation of the heater 32, the state of the stick and the state of the liquid, and may transmit the information to the user. The controller 51 may be electrically connected to the output unit 55. The controller 51 may control the output unit 550 to display the various information transmitted from the components to thus transmit the information to the user.

A memory 56 may store therein the data containing the information. The controller 51 may be electrically connected to the memory 56. The memory 56 may receive the data about the various information from the controller 51, and may store the data therein. Furthermore, the memory 56 may transmit the stored data to the controller 51. The controller 51 may control the operation of the components based on the data received from the memory 56.

The sensor 62 (see FIG. 11) may be an infrared sensor 62. The infrared sensor 62 may detect infrared rays emitted from the inside of the container 100. The infrared sensor 62 may include a light-emitting portion 621 and a light-receiving portion 622. The light-emitting portion 621 may emit infrared rays toward the inside of the container 100. The infrared rays, which is emitted from the light-emitting portion 621, may pass through the outer wall 110, the chamber 101 and the inner wall 12 in that order, and may be reflected by the stick. The reflected infrared rays may be transmitted to the light-receiving portion 622 through the inner wall 12, the chamber 101 and the outer wall 110 in that order. The light-receiving portion 622 may detect the infrared rays reflected by the object.

When liquid is stored in the chamber 101, the infrared rays may pass through the liquid. The liquid may have a predetermined refraction index with respect to the infrared ray. The amount of infrared radiation that is transmitted to the light-receiving portion 622 when the infrared rays pass through the liquid may be smaller than the amount of infrared radiation that is transmitted to the light-receiving portion 622 when the infrared rays do not pass through the liquid.

The value detected by the light-receiving portion 622 may vary according to the amount of infrared radiation detected by the light-receiving portion 622. For example, the larger the amount of infrared radiation reflected to the light-receiving portion 622, the greater the detected value. Furthermore, the smaller the amount of infrared radiation reflected to the light-receiving portion 622, the less the detected value. The amount of reflected infrared radiation may vary according to the reflectivity and the refractive index of an object.

The controller 51 may be connected to the infrared sensor 62. The controller 51 may receive a signal pertaining to the detected value from the infrared sensor 61. The controller 51 may determine the information based on the value detected by the infrared sensor 62. The controller 51 may determine the information by comparing the value detected by the infrared sensor 62 with a reference value. Each of the reference value and the detected value may be a current value.

Referring to FIGS. 14 and 15, the light-emitting portion 621 may emit infrared rays toward an object 623. The infrared rays may be reflected by the object 623, and may be transmitted to the light-receiving portion 622.

The light-receiving portion 622 may detect the infrared rays reflected by the object, and may determine the amount of current. The light-receiving portion 622 may be a phototransistor. The light-receiving portion 622 may include a collector 622*a* and an emitter 622*b*.

The light-receiving portion 622 may convert the detected value into an amount of current. For example, the larger the amount of infrared radiation reflected to the light-receiving portion 622, the larger the amount of current flowing in the collector 622*a* of the light-receiving portion 622. Conversely, the smaller the amount of infrared radiation reflected to the light-receiving portion 622, the smaller the amount of current flowing in the collector 622*a* of the light-receiving portion 622.

The controller 51 may determine at least one of the state of the stick and the state of the liquid based on the amount of current corresponding to the detected valued. The controller 51 may determine at least one of the state of the stick and the state of the liquid by comparing the amount of current corresponding to the detected value with a reference amount of current.

Referring to FIG. 16, the plug 41 may be disposed at the lower portion of the stick 40'. The granular portion 42 may be disposed between the plug 41 and the filter portion 43. The stick 40' may be referred to as an aerosol-generating member 40'.

A filter 411 may be disposed in the plug 41. The filter 411 may be made of paper. The filter 411 may be formed by crumpling a long paper sheet. Because the filter 411 is crumpled, gaps may be formed between the wrinkles of the crumpled paper.

Consequently, when aerosol flows through the filter 411, a portion of the aerosol may be introduced into the granular portion 42 while wetting the filter 411, and the remaining portion of the aerosol may be introduced into the granular portion 42 while passing through the gaps between the wrinkles in the filter 411.

Accordingly, when the aerosol flows, the aerosol may wet the filter 411 and thus the surface portion of the stick 40'.

The granular portion 42 may contain a medium therein. The aerosol-generating device may extract a certain ingredient from the medium by means of the aerosol. The granular portion 42 may be disposed above the plug 41.

The filter portion 43 may be disposed above the granular portion 42. A filter may be included in the filter portion 43. The filter may be a cellulose acetate filter.

A hollow portion 44 may be disposed above the filter portion 43. The hollow portion 44 may be configured to have the form of a hollow pipe.

A mouthpiece 45 may be disposed at the upper end portion of the stick 40'. The mouthpiece 45 may be disposed above the hollow portion 44. The mouthpiece 45 may include a filter therein. The filter may be a cellulose acetate filter. The plug 41, the granular portion 42, the filter portion 43, the hollow portion 44, and the mouthpiece 45 may be wrapped by a sheath. The sheath may be made of paper. The sheath may have a white color.

Referring to FIGS. 16 and 17, when the stick 40' is inserted into the inserting space 102 (see FIG. 2), the plug 41 may be disposed at the lower end of the inserting space 102. When the stick 40' is inserted into the inserting space 102, the granular portion 42 may be disposed in the inserting space 102. When the stick 40' is inserted into the inserting space 102, at least a portion of the filter portion 43 may be disposed in the inserting space 102.

When the stick 40' is inserted into the inserting space 102, the hollow portion 44 may be exposed to the outside. When the stick 40' is inserted into the inserting space 102, the mouthpiece 45 may be exposed to the outside.

The inserting space 102 may be configured to have a height H such that at least a portion of the filter portion 43 is disposed in the inserting space 102 when the stick 40' is completely inserted into the inserting space 102. The height H of the inserting space 102 may be greater than the distance between the lower end of the plug 41 and the upper end of the granular portion 42. The height H of the inserting space 102 may be less than the distance between the lower end of the plug 41 and the upper end of the filter portion 43.

The vertical length L1 of the plug 41 may be about 7 mm. The vertical length L2 of the granular portion 42 may be about 10 mm. The vertical length L3 of the filter portion 43 may be about 7 mm. The vertical length L4 of the hollow portion 44 may be about 12 mm. The vertical length L5 of the mouthpiece 45 may be about 12 mm.

The height H of the inserting space 102 may be 17 mm or greater. The height H of the inserting space 102 may be 24 mm or less. The height H of the inserting space 102 may be 22 mm.

The stick 40' may be divided into a first zone A1 and a second zone A2. The first zone A1 may be disposed in the inserting space 102 when the stick 40' is inserted into the inserting space 102. The second zone A2 may be exposed to the outside when the stick 40' is inserted into the inserting space 102. The length of the first zone A1 may correspond to the height H of the inserting space 102.

The first zone A1 may include the plug 41 and the granular portion 42. The first zone A1 may include at least a portion of the filter portion 43. The second zone A2 may include the hollow portion 44 and the mouthpiece 45. The second zone A2 may include at least a portion of the filter portion 43.

A marker 46 may be formed at the sheath of the stick 40'. The marker 46 may be printed on a portion of the sheath or around the entire periphery of the sheath.

The marker 46 may be positioned on a surface of at least a portion of the stick 40' that is inserted into the inserting space 102. The marker 46 may be formed in the first zone A1 of the stick 40'. The marker 46 may be formed at a location corresponding to at least one of the plug 41, the granular portion 42, and the filter portion 43 in the first zone A1.

The marker 46 may have a color different from the color of the sheath of the stick 40'. The marker 46 and the sheath may have different reflectivities with respect to an infrared radiation. For example, the sheath may have a white color, and the marker 46 may have a blue color.

The infrared sensor 62 may be disposed at a height corresponding to the marker 46 when the stick 40' is inserted into the inserting space 102.

For example, the marker 46 may be a zone of the sheath. Alternatively, the marker 46 may be a zone into which the light emitted from the light-emitting portion of the infrared sensor 62 is introduced.

For example, the marker 46 may be a strip formed along the periphery of the stick 40'. Consequently, the infrared sensor 62 is capable of detecting the marker 46 regardless of the orientation of the stick 40' inserted into the inserting space 102.

Referring to FIG. 17, the infrared sensor 62 may be disposed outside the container 10 or 100. The infrared sensor 62 may be disposed outside the outer wall 11 or 110 of the container 10 or 100. The infrared sensor 62 may be disposed so as to face the outer wall 11 or 110. The infrared sensor 62 may be disposed close to the outer wall 11 or 110. The infrared sensor 62 may be disposed so as to face the inserting space 102 (see FIG. 2). The infrared sensor 62 may detect the infrared rays emitted from the inside of the container 10 or 100.

The infrared sensor 62 may be disposed at a height close to the height of the marker 46. At least one infrared sensor 62 may be disposed between the upper and lower ends of the chamber 101 outside the container 10 or 100. The at least one infrared sensor 62 may be disposed between the upper and lower ends of the inserting space 102 outside the container 10 or 100. The at least one infrared sensor 62 may be disposed higher than the stepped surface 17 outside the container 10 or 100.

Referring to FIG. 18, the infrared sensor 62 may include the light-emitting portion 621 configured to emit infrared rays toward the inside of the container 10 or 100. The infrared sensor 62 may include the light-receiving portion 622 configured to receive the infrared ray.

The light-emitting portion 621 may emit infrared rays toward the inserting space 102. The light-emitting portion 621 may emit infrared rays toward the stick 40 or 40' inserted into the inserting space 102. The light-emitting portion 621 may emit infrared rays toward the marker 46 of the stick 40'.

The infrared rays emitted from the light-emitting portion 621 may be reflected by an object. The infrared rays may be reflected by the stick 40 or 40'. The infrared rays may be reflected by the marker 46 of the stick 40'. The light-receiving portion 622 may receive the reflected infrared ray.

The outer wall 11 or 110 and the inner wall 12 may be made of an infrared-transmissive material. The outer wall 11 or 110 and the inner wall 12 may be preferably made of a material having low reflectivity, a low refraction index, and high transmissivity with respect to infrared radiation.

The infrared rays emitted from the light-emitting portion 621 may pass through the outer wall 11 or 110, the chamber 101, and the inner wall 12 in that order. The infrared rays, having passed through the components, may be reflected by the stick 40 or 40', and may then pass through the inner wall 12, the chamber 101 and the outer wall 11 or 110 in that order. The reflected infrared rays may enter the light-receiving portion 622.

Referring to FIG. 19, the amount of reflected infrared radiation may vary depending on the reflectivity and refractive index of an object. The light-receiving portion 622 may detect a certain value corresponding to the amount of reflected infrared radiation.

Referring to (a) in FIG. 19, when the stick 40 or 40' is not inserted into the inserting space 102, the amount of reflected infrared radiation may be zero or almost zero.

The stick 40, which is not provided with the marker 46, may be referred to as a first stick 40, and the stick 40', which is provided with the marker 46, may be referred to as a second stick 40'. The first stick 40 may be referred to as the first type aerosol-generating member 40. The second stick 40' may be referred to as the second type aerosol-generating member 40'.

As illustrated in (b) and (c) in FIG. 19, the infrared rays, which is emitted from the infrared sensor 62, may be reflected by the stick 40 or 40' and may be transmitted to the infrared sensor 62 when the stick 40 or 40' is inserted into the inserting space 102. The amount of infrared radiation reflected by the marker 46 of the second stick 40' ((c) in FIG. 19) may be smaller than the amount of infrared radiation reflected by the first stick 40 ((b) in FIG. 19).

Consequently, the value detected by the infrared sensor 62 may vary depending on whether or not the stick 40 or 40' is inserted and on the kind of the stick 40 or 40'.

Referring to FIG. 20, when an aerosol is introduced into the second stick 40', the marker 46 may be wetted by the aerosol, and may thus change color. The larger the amount of introduced aerosol, the stronger the color of the marker 46. The reflectivity of the marker 46 with respect to infrared rays may vary due to the change in the color of the marker 46.

In the case of the second stick 40', which is not used ((a) in FIG. 20), the color of the marker 46*a* may not be changed, and may thus have the highest reflectivity. In the case of the second stick 40', into which an aerosol is introduced ((b) in FIG. 20), the color of the marker 46*b* may be stronger than the color in (a) in FIG. 20, and may thus have a lower reflectivity. In the case of the second stick 40', into which a larger amount of aerosol is introduced ((c) in FIG. 20), the color of the marker 46*c* may be stronger than the color in (b) in FIG. 20, and may thus have further lower reflectivity.

Consequently, the value detected by the infrared sensor 62 may vary according to the amount of stick 40' that is used.

Referring to FIG. 21, when the infrared sensor 62 is turned on (S10), the infrared sensor 62 may detect an infrared ray. Furthermore, when the infrared sensor 62 is turned on (S10), the controller 51 may receive the value X detected by the infrared sensor 62. The detected value X may vary according to the amount of infrared radiation transmitted to the infrared sensor 62.

The controller 51 may compare the value X detected by the infrared sensor 62 with stick reference values RSn (n=1, 2, 3, . . . ) (S20). The memory 56 may store the stick reference value RSn therein. The controller 51 may receive the stick reference value RSn from the memory 56, and may treat the stick reference value RSn. The stick reference value may be referred to as a reference value.

The controller 51 may compare the detected value X with the stick reference value RSn (S20), and may determine the state of the stick (S30). The controller 51 may compare the detected value X with the stick reference value RSn, and may determine the range to which the detected value X belongs.

The controller 51 may control the components connected thereto, based on the information determined in operation S30. The controller 51 may control the output unit 55 to display the information determined in operation S30.

When the infrared sensor 62 is turned off (Yes in operation S40) after the controller 51 determines the state of the stick (S30), the controller 51 may terminate the operation. When the infrared sensor 62 is not turned off (No in operation S40) after the controller 51 determines the state of the stick, the controller 51 may compare the detected value X with the stick reference value RSn (S20), and may determine the state of the stick (S30).

Referring to FIG. 22, when the infrared sensor 62 is turned on (S10) and the infrared sensor 62 detects the infrared rays, the controller 51 may compare the detected value X with the stick reference value RSn (S20). The controller 51 may determine whether or not the stick is inserted, the kind of stick that is inserted, and the extent to which the stick is used, based on the result of comparison of the detected value X with the stick reference value RSn.

When the stick 40 or 40' is inserted into the inserting space 102, the detected value X may exceed the stick reference value RS1. When the detected value X exceeds the first stick reference value RS1 (Yes in operation S21), the controller 51 may determine that the stick 40 or 40' is inserted into the inserting space 102.

When the stick 40 or 40' is not inserted into the inserting space 102, the detected value X may be equal to or lower than the first stick reference value RS1. When the detected value X is equal to or lower than the first stick reference value RS1 (No in operation S21), the controller 51 may determine that the stick 40 or 40' is not inserted into the inserting space 102 (S312).

When the first stick 40 is inserted into the inserting space 102, the detected value X may exceed the second stick reference value RS2. When the detected value X exceeds the second stick reference value RS2 (Yes in operation S22), the controller 51 may determine that the first stick 40 is inserted into the inserting space 102 (S321).

When the second stick 40' is inserted into the inserting space 102, the detected value X may be equal to or lower than the second stick reference value RS2. In other words, when the second stick 40' is inserted into the inserting space 102, the detected value X may exceed the first stick reference value RS1 but may be equal to or lower than the second stick reference value RS2.

The detected value X when the second stick 40' is inserted into the inserting space 102 may be the detected value X caused by the infrared rays reflected by the marker 46 on the second stick 40'. When the detected value X is equal to or lower than the second stick reference value RS2 (No in operation S22), the controller 51 may determine that the second stick 40' is inserted into the inserting space 102 (S322).

In the operation of determining the state of the stick, the controller 51 may determine the range of stick reference values RSn within which the detected value of X belongs, and there is no need to perform the operation in the above-mentioned sequence.

The first stick reference value RS1 may be set so as to distinguish the case in which the stick 40 or 40' is inserted into the inserting space 102 from the case in which the stick 40 or 40' is not inserted into the inserting space 102. The amount of infrared radiation reflected to the infrared sensor 62 may be smaller in the case in which the stick 40 or 40' is not inserted into the inserting space 102 than in the case in which the stick 40 or 40' is inserted into the inserting space 102. The first stick reference value RS1 may be set so as to be in the range between the detected value X when the stick 40 or 40' is inserted into the inserting space 102 and the detected value X when the stick 40 or 40' is not inserted into the inserting space 102.

The second reference value RS2 may be set so as to distinguish the case in which the first stick 40 is inserted into the inserting space 102 from the case in which the second stick 40' is inserted into the inserting space 102. The amount of infrared radiation reflected to the infrared sensor 62 may be smaller in the case in which the second stick 40' is inserted into the inserting space 102 than in the case in which the first stick 40 is inserted into the inserting space 102. The second stick reference value RS2 may be set so as to be in the range between the detected value X when the first stick 40 is inserted into the inserting space 102 and the detected value X when the second stick 40' is inserted into the inserting space 102.

When the infrared sensor 62 is turned off after the controller 51 determines the state of the stick (Yes in operation S40), the controller 51 may terminate the operation. When the infrared sensor 62 is not turned off after the controller 51 determines the state of the stick (No in operation S40), the controller 51 may again determine the state of the stick by comparing the stick reference value RSn with the detected value X.

The amount of infrared radiation that is transmitted to the infrared sensor 62 when infrared rays penetrates through the liquid in the chamber 101, and the amount of infrared radiation that is transmitted to the infrared sensor 62 when infrared rays does not penetrate through the liquid in the chamber 101 may be different from each other. When infrared rays penetrates through the liquid in the chamber 101, the amount of infrared radiation that is transmitted to the infrared sensor 62 may vary due to the refractive index of the liquid. The stick reference value RSn may be set so as to accommodate the detected value X, which changes depending on the presence of the liquid.

In summary, referring to FIGS. 1 to 22, an aerosol-generating device according to an aspect of the present disclosure includes an elongated container 10 or 100 comprising an inner wall 12 and an outer wall 11 or 110, wherein the inner wall defines an inserting space 102 configured to accommodate insertion of the an aerosol-generating member, and wherein a chamber 101 configured to store liquid is defined between the inner wall 12 and the outer wall 11 or 110, a wick 31 disposed at an end of the inserting space 102, a heater 32 configured to heat the wick 31, a passage unit 20 defined between the inserting space 102 and the wick 31, and an infrared sensor 62 disposed outside and adjacent to the inserting space 102.

In another aspect of the present disclosure, wherein the outer wall of the container includes: a first surface positioned adjacent to the infrared sensor; and a second surface disposed opposite the first surface and having a shape different from the first surface.

In another aspect of the present disclosure, wherein the second surface is rounded.

In another aspect of the present disclosure, The aerosol-generating device further comprising an upper housing disposed adjacent to the first surface and comprising a reception space therein, wherein a third surface of the upper housing is positioned to face the first surface, wherein the infrared sensor is disposed in the reception space of the upper housing to face the first surface.

In another aspect of the present disclosure, wherein the first surface and the third surface are parallel to each other.

In another aspect of the present disclosure, wherein the upper housing comprises a fourth surface disposed opposite the third surface and having a shape different from the third surface.

In another aspect of the present disclosure, wherein the fourth surface is rounded.

In another aspect of the present disclosure, The aerosol-generating device further comprising a controller configured to determine a state of the aerosol-generating member based on a comparison between a value detected by the infrared sensor and a reference value.

In another aspect of the present disclosure, wherein the controller is configured to determine that the aerosol-generating member is inserted into the insert space based on the detected value exceeding a first reference value, and determine that no aerosol-generating member is inserted into the insert space based on the detected value being less than or equal to the first reference value.

In another aspect of the present disclosure, wherein the controller is configured to:

determine that a first type aerosol-generating member is inserted into the insert space based on the detected value exceeding both the first reference value and a second reference value; and determine that a second type aerosol-generating member is inserted into the insert space based on the detected value exceeding the first reference value but being less than or equal to the second reference value.

In another aspect of the present disclosure, wherein a position of the infrared sensor with respect to a length of the insert space corresponds to a position of a marker on a surface of the aerosol-generating member when the aerosol-generating member is inserted into the insert space.

In another aspect of the present disclosure, The aerosol-generating device according to claim 1, wherein the outer wall and the inner wall of the container are made of a light-permeable material.

Certain embodiments or other embodiments of the disclosure described above are not mutually exclusive or distinct from each other. Any or all elements of the embodiments of the disclosure described above may be combined with each other or with other elements in configuration or function.

For example, a configuration "A" described in one embodiment of the disclosure and the drawings and a configuration "B" described in another embodiment of the disclosure and the drawings may be combined with each other. That is, even if a combination of configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An aerosol-generating device comprising:

an elongated container comprising an inner wall and an outer wall, wherein the inner wall defines an insert space configured to accommodate insertion of an aerosol-generating member, and wherein a chamber configured to store liquid is defined between the inner wall and the outer wall;

a wick disposed at an end of the insert space;

a heater configured to heat the wick;

a passage formed between the insert space and the wick; and an infrared sensor disposed adjacent to the container, wherein the outer wall and the inner wall of the container are made of a light-permeable material.

2. The aerosol-generating device according to claim 1, wherein the outer wall of the container includes:

a first surface positioned adjacent to the infrared sensor; and a second surface disposed opposite the first surface and having a shape different from the first surface.

3. The aerosol-generating device according to claim 2, wherein the second surface is rounded.

4. The aerosol-generating device according to claim 3, further comprising an upper housing disposed adjacent to the first surface and comprising a reception space therein, wherein a third surface of the upper housing is positioned to face the first surface, and wherein the infrared sensor is disposed in the reception space of the upper housing to face the first surface.

5. The aerosol-generating device according to claim 4, wherein the first surface and the third surface are parallel to each other.

6. The aerosol-generating device according to claim 4, wherein the upper housing comprises a fourth surface disposed opposite the third surface and having a shape different from the third surface.

7. The aerosol-generating device according to claim 6, wherein the fourth surface is rounded.

8. The aerosol-generating device according to claim 1, further comprising a controller configured to determine a state of the aerosol-generating member based on a comparison between a value detected by the infrared sensor and a reference value.

9. The aerosol-generating device according to claim 8, wherein the controller is configured to determine that the aerosol-generating member is inserted into the insert space based on the detected value exceeding a first reference value, and determine that no aerosol-generating member is inserted into the insert space based on the detected value being less than or equal to the first reference value.

10. The aerosol-generating device according to claim 9, wherein the controller is configured to:

determine that a first type aerosol-generating member is inserted into the insert space based on the detected value exceeding both the first reference value and a second reference value; and determine that a second type aerosol-generating member is inserted into the insert space based on the detected value exceeding the first reference value but being less than or equal to the second reference value.

11. The aerosol-generating device according to claim 10, wherein a position of the infrared sensor with respect to a length of the insert space corresponds to a position of a marker on a surface of the aerosol-generating member when the aerosol-generating member is inserted into the insert space.

12. An aerosol-generating device comprising:

an elongated container comprising an inner wall and an outer wall, wherein the inner wall defines an insert space configured to accommodate insertion of an aerosol-generating member, and wherein a chamber configured to store liquid is defined between the inner wall and the outer wall;

a wick disposed at an end of the insert space;

a heater configured to heat the wick;

a passage formed between the insert space and the wick; and an infrared sensor disposed adjacent to the container and configured to emit infrared light through the inner wall and outer wall and detect a value based on the infrared light reflected by the aerosol-generating member inserted in the insert space.

* * * * *